US011332304B2

(12) United States Patent
Georgelos et al.

(10) Patent No.: US 11,332,304 B2
(45) Date of Patent: May 17, 2022

(54) LINER FOR BEVERAGE AND FOOD VESSELS

(71) Applicant: Corplex Plastics UK Ltd., Gloucester (GB)

(72) Inventors: Paul N. Georgelos, Naperville, IL (US); Kosmas Kasimatis, Chicago, IL (US)

(73) Assignee: CORPLEX PLASTICS UK LTD, Gloucester (GB)

( * ) Notice: Subject to any disclaimer, the term of this patent is extended or adjusted under 35 U.S.C. 154(b) by 458 days.

(21) Appl. No.: 15/246,680

(22) Filed: Aug. 25, 2016

(65) Prior Publication Data

US 2017/0057736 A1 Mar. 2, 2017

Related U.S. Application Data

(60) Provisional application No. 62/275,520, filed on Jan. 6, 2016, provisional application No. 62/211,301, filed on Aug. 28, 2015.

(51) Int. Cl.
*B65D 85/72* (2006.01)
*B65D 33/16* (2006.01)
(Continued)

(52) U.S. Cl.
CPC ..... *B65D 85/72* (2013.01); *B31B 70/8137* (2017.08); *B31B 70/844* (2017.08);
(Continued)

(58) Field of Classification Search
CPC .. B65D 85/72; B65D 33/165; B65D 75/5861; B67D 3/0061; B31B 70/855; B31B 70/844; B31B 70/8137; B31B 2160/10
(Continued)

(56) References Cited

U.S. PATENT DOCUMENTS 2,446,308 A 8/1948 Smith
2,800,269 A 7/1957 Smith
(Continued)

FOREIGN PATENT DOCUMENTS

AU 199718381 8/1997
DE 20204830 9/2002
(Continued)

OTHER PUBLICATIONS

Canadian Office Action; Patent Application No. 2996660; dated Mar. 21, 2018; 4 pages.
(Continued)

*Primary Examiner* — Anthony D Stashick
*Assistant Examiner* — Blaine G Neway
(74) *Attorney, Agent, or Firm* — McAndrews, Held & Malloy, Ltd.

(57) ABSTRACT

A liner for use with a fluid dispensing vessel. The liner includes a flexible pouch defining an interior region and configured to be placed in a fluid dispensing vessel. The pouch includes a top end that is partially sealed and that includes a first opening. The pouch includes a fluid passageway defined by at least two sealed boundaries and that leads from the opening to the interior region. The pouch includes a bottom end that includes a second opening. The liner includes a fluid dispensing fitment connected to the pouch and configured to be in fluid communication with interior region via the second opening. When fluid is poured into the interior region of the pouch through the opening, it can be dispensed from the pouch through the fitment.

27 Claims, 26 Drawing Sheets

(51) Int. Cl.

| | |
|---|---|
| ***B67D 3/00*** | (2006.01) |
| ***B65D 77/06*** | (2006.01) |
| ***B65D 75/58*** | (2006.01) |
| ***B65D 5/60*** | (2006.01) |
| ***B65D 30/20*** | (2006.01) |
| ***B65D 75/56*** | (2006.01) |
| ***B65D 77/10*** | (2006.01) |
| ***B31B 70/855*** | (2017.01) |
| ***B31B 70/84*** | (2017.01) |
| ***B31B 70/81*** | (2017.01) |
| *B31B 160/10* | (2017.01) |
| *B31B 160/20* | (2017.01) |
| *B31B 155/00* | (2017.01) |
| *B31B 120/40* | (2017.01) |

(52) U.S. Cl.

CPC ..... *B31B 70/855* (2017.08); *B65D 5/60* (2013.01); *B65D 31/10* (2013.01); *B65D 33/165* (2013.01); *B65D 75/566* (2013.01); *B65D 75/5861* (2013.01); *B65D 77/06* (2013.01); *B65D 77/065* (2013.01); *B65D 77/067* (2013.01); *B65D 77/10* (2013.01); *B67D 3/0061* (2013.01); *B67D 3/0067* (2013.01); *B31B 2120/402* (2017.08); *B31B 2155/001* (2017.08); *B31B 2155/002* (2017.08); *B31B 2160/10* (2017.08); *B31B 2160/20* (2017.08); *B65D 2231/001* (2013.01)

(58) Field of Classification Search

USPC .... 220/62.11, 62.12, 601, 604; 383/41, 210; 222/107

See application file for complete search history.

(56) References Cited

U.S. PATENT DOCUMENTS 2,804,257 A * 8/1957 Hasler ..... B65D 31/145 383/36
2,815,887 A 12/1957 Ford et al.
2,831,610 A 4/1958 Dennie
3,087,655 A 4/1963 Scholle
3,112,047 A 11/1963 Weinreich et al.
3,123,254 A 3/1964 Rabby et al.
3,137,415 A 6/1964 Faunce
3,173,579 A 3/1965 Curie et al.
3,178,063 A 4/1965 Cox, Jr.
3,183,905 A 5/1965 Kirchner
3,212,681 A 10/1965 Weikert
3,253,764 A 5/1966 Goetschius et al.
3,186,626 A 6/1968 Shvetz
3,613,954 A 10/1971 Bayne
3,631,793 A 1/1972 Bednartz
3,797,734 A * 3/1974 Fleury ..... A61J 19/00 383/36
3,827,341 A 8/1974 Stage
D248,218 S 6/1978 Clumb
4,138,036 A 2/1979 Bond
4,165,024 A 8/1979 Oswalt et al.
4,257,535 A 3/1981 Mellett
4,314,654 A 2/1982 Gaubert
4,322,018 A 3/1982 Rutter
4,338,365 A 7/1982 Russo
4,513,885 A 4/1985 Hogan
4,516,692 A 5/1985 Croley
4,516,693 A 5/1985 Gaston
4,524,459 A 6/1985 Titchenal
4,549,673 A 10/1985 Kupersmit
4,601,410 A 7/1986 Bond
4,756,422 A 7/1988 Kristen
4,785,974 A 11/1988 Rudick et al.
4,796,788 A 1/1989 Bond
4,960,227 A 10/1990 Coleman
4,981,374 A 1/1991 Rutter et al.
5,064,096 A 11/1991 Illing et al.
5,139,151 A 8/1992 Chelak
5,186,359 A 2/1993 Brown et al.
5,334,180 A 8/1994 Adolf et al.
5,427,284 A 6/1995 Inch
5,551,602 A 9/1996 Kurtzahn et al.
5,554,423 A 9/1996 Abate
5,647,511 A 7/1997 Bond
5,749,493 A * 5/1998 Boone ..... B65D 75/5877 222/105
5,788,121 A 8/1998 Sasaki et al.
5,797,524 A 8/1998 Lentz
5,915,596 A * 6/1999 Credle, Jr. ..... B65D 77/065 222/105
5,941,421 A * 8/1999 Overman ..... B65D 75/5877 222/105
D413,802 S 9/1999 Glover et al.
5,988,422 A 11/1999 Vallot
6,045,006 A * 4/2000 Frazier ..... B65D 77/065 222/105
6,053,360 A 4/2000 Rutter
6,073,807 A 6/2000 Wilford et al.
6,116,467 A * 9/2000 Petriekis ..... B65D 77/06 141/114
D440,631 S 4/2001 Shipway
6,374,579 B1 4/2002 Muller
6,375,040 B1 4/2002 Allanson et al.
D465,156 S 11/2002 Glover et al.
6,607,097 B2 8/2003 Savage et al.
6,609,636 B1 8/2003 Petriekis et al.
6,821,539 B2 11/2004 Lassota
6,883,683 B1 * 4/2005 Cunningham ..... B65D 75/58 222/107
6,951,696 B2 10/2005 Ozaki
7,017,781 B2 * 3/2006 Provenza ..... B65D 77/062 222/105
7,077,309 B2 7/2006 Andrews, Sr.
7,334,702 B2 2/2008 Cunningham et al.
7,546,918 B2 * 6/2009 Gollier ..... A61J 1/2093 206/219
7,678,097 B1 * 3/2010 Peluso ..... B29C 65/8223 604/412
7,980,410 B2 7/2011 DeMuinck
8,075,188 B2 * 12/2011 Plunkett ..... B65D 31/02 383/105
8,196,873 B2 6/2012 Kohn et al.
D676,320 S 2/2013 Richards et al.
8,408,790 B2 4/2013 Reilly
8,651,332 B2 2/2014 Pauze et al.
8,752,734 B2 6/2014 Smith et al.
8,757,441 B2 6/2014 Smith et al.
8,939,351 B2 1/2015 Goudreau et al.
9,033,186 B2 5/2015 Smith et al.
9,278,496 B2 3/2016 Sondaar
D757,848 S * 5/2016 Takahashi ..... D18/50
D766,083 S 9/2016 Trettin et al.
D786,693 S * 5/2017 McNabb ..... D9/703
10,377,549 B2 8/2019 De Muinck
2005/0034807 A1 2/2005 Wu et al.
2006/0016341 A1 1/2006 Wilson et al.
2006/0023973 A1 2/2006 Plunkett et al.
2008/0267538 A1 10/2008 Stephenson
2009/0238495 A1 * 9/2009 Anderson ..... A61J 1/10 383/7
2009/0272819 A1 11/2009 Charpie et al.
2010/0200613 A1 8/2010 Smith et al.
2011/0293202 A1 12/2011 Takeda et al.
2013/0034315 A1 2/2013 McCall
2013/0037568 A1 2/2013 Smith et al.
2014/0044379 A1 2/2014 Gum
2014/0185966 A1 7/2014 Umenaka
2014/0239012 A1 8/2014 Smith et al.
2015/0122844 A1 5/2015 Klein et al.
2015/0210527 A1 7/2015 Smith et al.
2015/0359379 A1 12/2015 Peterson et al.
2016/0083161 A1 3/2016 Moriz et al.

(56) References Cited

U.S. PATENT DOCUMENTS

FOREIGN PATENT DOCUMENTS

| | | | |
|---|---|---|---|
| DE | 202009002028 | | 9/2010 |
| EP | 0816243 | | 1/1998 |
| EP | 2223689 | A1 | 9/2010 |
| EP | 2471723 | A1 | 7/2012 |
| EP | 2684812 | | 1/2014 |
| FR | 1605557 | | 7/1980 |
| GB | 689714 | A | 4/1953 |
| GB | 870180 | | 6/1961 |
| GB | 1591323 | | 6/1981 |
| GB | 2354754 | A | 4/2001 |
| GB | 2377424 | | 1/2003 |
| JP | 2010149907 | A | 7/2010 |
| WO | 9316931 | | 9/1993 |
| WO | 2004022440 | | 3/2004 |
| WO | 2016128218 | | 8/2016 |

OTHER PUBLICATIONS

Notification of Transmittal of the International Search Report and the Written Opinion of the International Searching Authority, or the Declaration; PCT/US2016/001251; dated Jan. 3, 2017; 12 pages.
Plascon product sheet for Liquid Bulk Liners, dated Feb. 12, 2015, http://www.plascongroup.com/liquid-liners.html, 2 pages.
Parish product sheet for Liners for Insulated Beverage Dispensers, dated Feb. 12, 2015, http://parishmfg.com/beverage-dispense-liners/liners-for-insulated-beverage-dispensers/, 5 pages.
Canadian Office Action; Patent Application No. 2996660; dated Sep. 6, 2019, 3 pages.

* cited by examiner

LINER FOR BEVERAGE AND FOOD VESSELS

RELATED APPLICATIONS

This application makes reference and claims priority to U.S. Provisional Patent Application No. 62/211,301, filed on Aug. 28, 2015 and titled "Beverage Urn Liner," and to U.S. Provisional Patent Application No. 62/275,520, filed on Jan. 6, 2016 and titled "Liner For Beverage Urns And Condiment Dispensers." U.S. Provisional Patent Application Nos. 62/211,301 and 62/275,520 are hereby incorporated by reference herein in their entireties.

BACKGROUND

Embodiments of the present invention generally relate to a disposable assembly for use with a reusable urn or vessel for dispensing fluids and more particularly a disposable urn liner assembly having a pouch and a fitment and/or tube on the pouch that are inserted into a fluid chamber of a reusable urn for dispensing beverages or flowable foods from the urn for human consumption.

Self-service dispensing containers have become very popular in restaurant settings for storing and dispensing liquid beverages. Such containers typically include a reusable vessel or urn with a dispensing valve, faucet, or spigot at the bottom for gravitational dispensing of product therein. With reference to FIGS. 1*a* and 1*b*, in some instances the vessel 12 is fitted with a disposable plastic liner assembly 10 that includes a plastic film pouch 14 having an open top end 18 and a small opening 22 proximate a bottom end 24. A fitment and tube assembly 26 is attached to the pouch 14 at the small opening 22. The liner 10 is placed inside the vessel 12 and the tube 26 is passed through the valve 16. The edges of the pouch 14 at the open top end 18 are folded over the edge of the vessel 12 and may be secured to the outer wall of the vessel 12 by a band. This keeps the top of the pouch 14 open so that a liquid beverage, such as iced tea, can be poured into or made in the pouch 14 without the liquid coming into contact with any portion of the reusable vessel 12 or valve 16. Once the liquid is in the pouch 14, a lid can be placed on top of the vessel 12 and over the open top end 18 of the pouch 14. In this way, the vessel 12 and valve 16 remain clean for longer periods of time and can be more easily and quickly cleaned during normal cleaning procedures. An example of an urn liner is described in U.S. Pat. No. 6,116,467, which is incorporated herein by reference.

SUMMARY

Certain aspects of the present technology provide a liner for use with a fluid dispensing vessel. The liner includes a flexible pouch defining an interior region and configured to be placed in a fluid dispensing vessel. The pouch includes a top end that is partially sealed and that includes a first opening. The pouch includes a fluid passageway defined by at least two sealed boundaries and that leads from the opening to the interior region. The pouch includes a bottom end that includes a second opening. The liner includes a fluid dispensing fitment connected to the pouch and configured to be in fluid communication with interior region via the second opening. When fluid is poured into the interior region of the pouch through the opening, it can be dispensed from the pouch through the fitment.

Certain aspects of the present technology provide a liner for use with a fluid dispensing vessel. The liner includes a flexible pouch having a top end, a bottom end, and first and second sides that define an interior region. The pouch is configured to be placed in a fluid dispensing vessel. The liner includes a top region of the pouch that includes a first seal that defines the top end. The top region also includes a perforation located below the first seal and that is generally parallel to the first seal, and that extends from the first side across a portion of the width of the pouch. The top region includes a second seal that is located between the perforation and the second side of the pouch. A portion of the top region can be torn from the pouch along the perforation from the first side toward the second side but not beyond the second seal to create a tear strip and to create a top opening in the pouch that leads to the interior region. The second seal connects the tear strip to the pouch, and the tear strip can be used to tie up the pouch to close off the top opening. The liner includes a bottom region of the pouch that includes a bottom opening and a fluid dispensing fitment connected to the pouch and configured to be in fluid communication with the interior region via the bottom opening. When fluid is poured into the interior region of the pouch through the top opening, the top opening is closed off with the tear strip, and liquid is dispensed from the pouch through the fitment.

Certain aspects of the present technology provide a liner for use with a fluid dispensing vessel. The liner includes a flexible pouch having a top opening and a sealed bottom region. The liner includes a front panel, a rear panel, a first side panel, and a second side panel that define an interior region. The front, rear, and first and second side panels each include a triangular bottom portion, and the first and second side panels are folded inward to have gussets. The liner includes a fluid dispensing fitment connected to the pouch and configured to be in fluid communication with the interior region. When the pouch is filled with fluid through the top opening, the gussets unfold and the triangular bottom portions fold such that the bottom region becomes generally flat along a bottom end and has a generally quadrilaterally shaped footprint and liquid is dispensed from the pouch through the fitment.

Certain aspects of the present technology provide a method for making a gusseted liner for use with a beverage dispensing vessel. The method includes the steps of forming a tube of plastic film and folding the tube to have a front panel, a rear panel, a first folded side panel extending between the front and rear panels, and a second folded side panel extending between the front and rear panels. The method also includes the steps of slitting the tube to separate the front panel from the first and second side panels, forming a hole in the front panel, and connecting a fluid dispensing fitment to the front panel such that the fitment is in fluid communication with the hole. The method also includes the steps of sealing an inner side of the front panel to top inner sides of the first and second folded side panels with side seals and sealing the inner side of the front panel to the top inner sides of the folded first and second side panels with first bottom seals. The method also includes the step of sealing an inner side of the rear panel to bottom inner sides of the first and second folded side panels with second bottom seals. The method further includes the steps of trimming excess film located beneath the first and second bottom seals to define triangular shaped bottom ends of the front panel, rear panel, and first and second side panels, and trimming film located at the top of the tube to define a top end of the liner.

Certain aspects of the present technology provide a method for making a gusseted liner for use with a beverage dispensing vessel. The method includes the steps of forming a front panel from a first ply of plastic film and forming a rear panel with first and second side panels from a second ply of plastic film. The method also includes the steps of folding the first and second side panels to form gussets in the first and second side panels, forming a hole the front panel, and connecting a fluid dispensing fitment to the front panel such that the fitment is in fluid communication with the hole. The method further includes the steps of sealing an inner side of the front panel to top inner sides of the first and second folded side panels with side seals, sealing the inner side of the front panel to the top inner sides of the folded first and second side panels with first bottom seals, and sealing an inner side of the rear panel to bottom inner sides of the first and second folded side panels with second bottom seals. The method further includes trimming excess film located beneath the first and second bottom seals to define triangular shaped bottom ends of the front panel, rear panel, and first and second side panels and trimming film located at the top of the tube to define a top end of the liner.

Figure 1A:
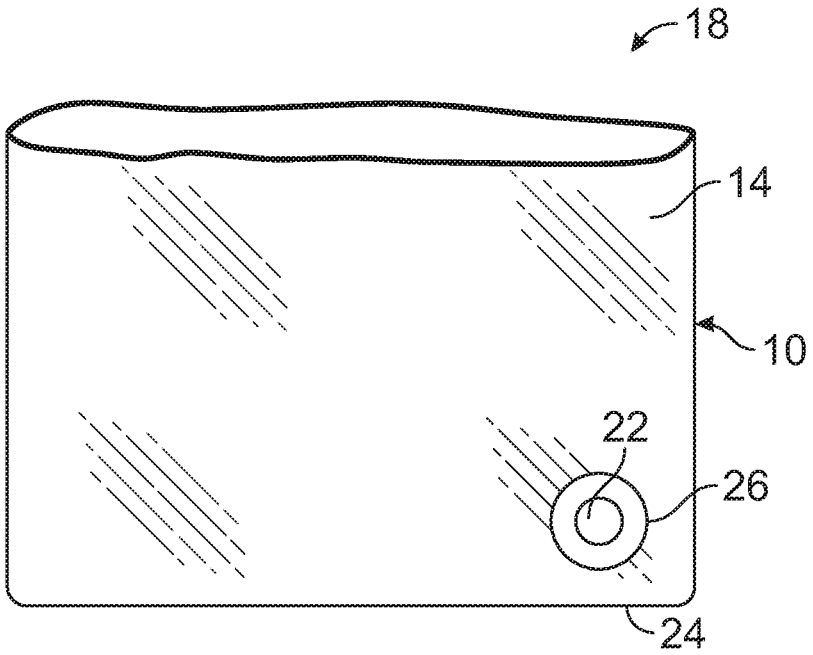
FIG. 1*a* is a front view of a liner for use in a beverage vessel.

The foregoing summary, as well as the following detailed description of certain embodiments of the present invention (s), will be better understood when read in conjunction with the appended drawings. For the purpose of illustrating the invention(s), there is shown in the drawings, certain embodiments. It should be understood, however, that the present invention(s) is not limited to the arrangements and instrumentality shown in the attached drawings.

DETAILED DESCRIPTION OF PREFERRED EMBODIMENTS

FIGS. 2-11 illustrate side views of embodiments of an urn liner that is partially or mostly sealed at the top end thereof.

The liners define a pouch and are made of flexible material, preferably a plastic film. The liners are configured to be placed in a containing vessel or urn (such as the one shown in FIG. 1*b*) through the top opening of the vessel and then filled with liquid while in the vessel. The top opening of the vessel can then be covered with a lid, which covers the filled liner inside of the vessel as well. The liners also include a fitment assembly that includes a spout and a dispensing tube. The tube can be integrally formed with the spout or be removably connectable to the spout. In addition, the tube can be connected to the spout by an adapter. The tube is extended through a valve (such as the one shown in FIG. 1*b*) attached to the vessel to dispense the liquid from the interior region of the liner pouch.

Figure 2:
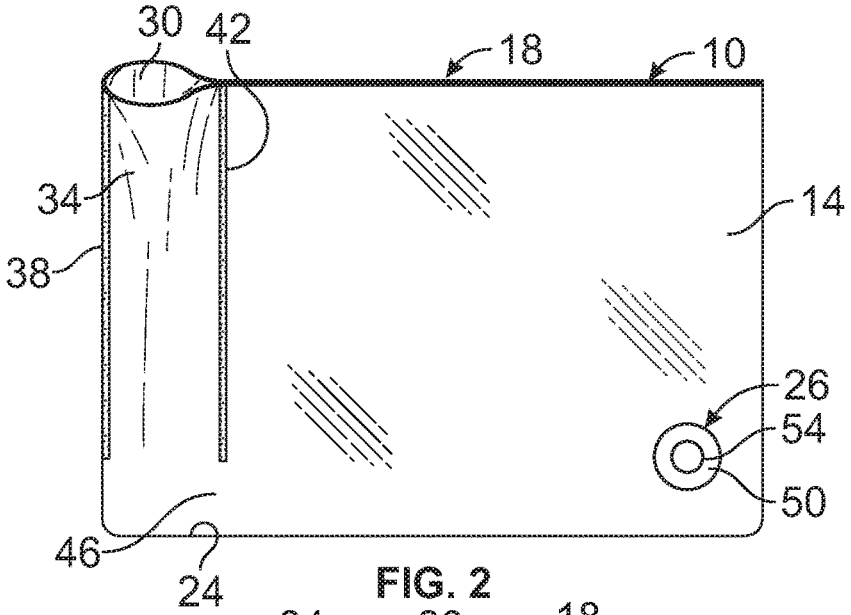
FIG. 2 is a perspective side view of a liner according to an embodiment of the present technology.

With respect to FIG. 2, the liner 10 includes a sealed top end 18 with a small opening 30 at one side of the top end 18. The liner 10 defines a pouch 14 having an interior region 48. The opening 30 leads to a passageway 34 in the pouch 14 that is defined by an outer side or seal 38 of the liner 10 that extends from the top end 18 of the liner 10 to the bottom end 24 of the liner 10 and an inner side seal 42 that extends down from the top end 18 of the liner 10 for most of the height of the liner 10 but not to the bottom end 24 of the liner 10. The bottom of the second seal 42 and the bottom seal or end 24 of the liner 10 define a channel 46 that allows liquid to enter the interior region 48 of the pouch 14. The liner 10 also includes a fitment assembly 26 that includes a spout 50 and dispensing tube 54. The tube 50 is extended through a valve in an urn to dispense the liquid from the interior region 48 of the pouch 14. Alternatively, the opening 30 can be located on the other side of the liner 10.

Figure 3:
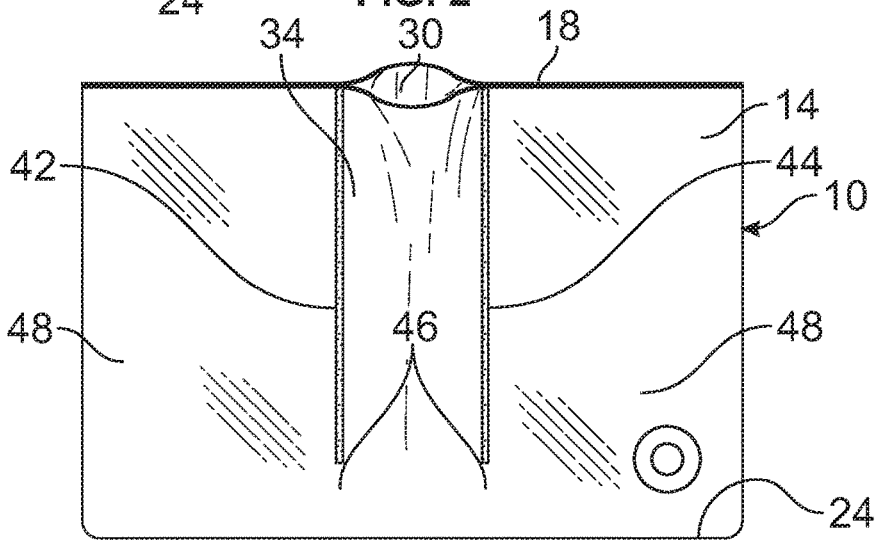
FIG. 3 is a perspective side view of a liner according to an embodiment of the present technology.

With respect to FIG. 3, the liner 10 includes a sealed top end 18 with a small opening 30 in the middle of the top end 18. The opening 30 leads to a passageway 34 that is defined by two generally parallel seals 42 and 44 that extend from the top end 18 at the opening 30 down toward the bottom 24 of the liner 10. The seals 42 and 44 do not extend all the way to the bottom 24 of the liner 10. The bottoms of the seals 42 and 44 and the bottom 24 of the liner 10 define channels 46 for liquid to enter interior regions 48 of the pouch 14.

Figure 4:
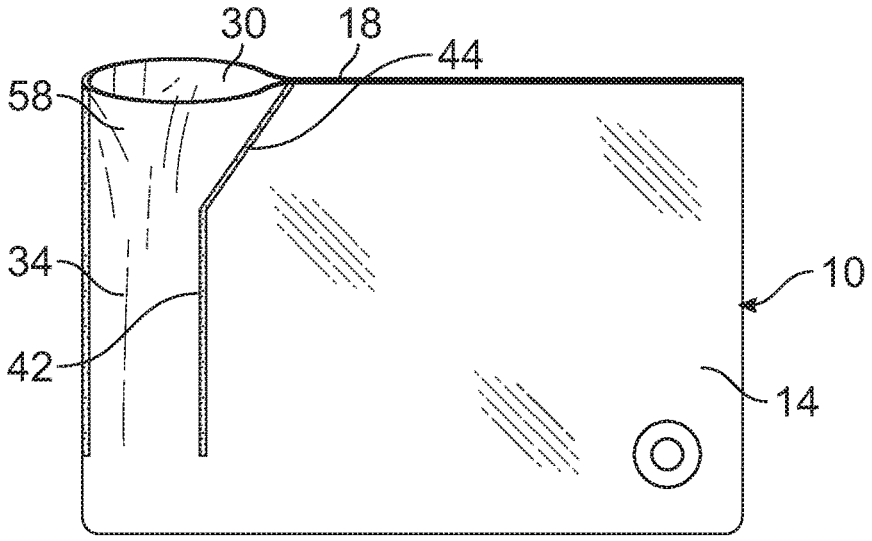
FIG. 4 is a perspective side view of a liner according to an embodiment of the present technology.

FIG. 4 illustrates a liner 10 that is similar to the liner of FIG. 2 except that it includes a larger opening 30 and a diagonal seal 44 that extends from the top end 18 to the inner side seal 42 in order to form a funnel 58 that leads to the passageway 34. The larger opening 30 and funnel 58 can accommodate a variety of differently sized dispenser mouths from which liquid, such as tea or coffee, is poured into the pouch 14. Alternatively, the funnel 58 can be located on the other side of the liner 10.

Figure 5:
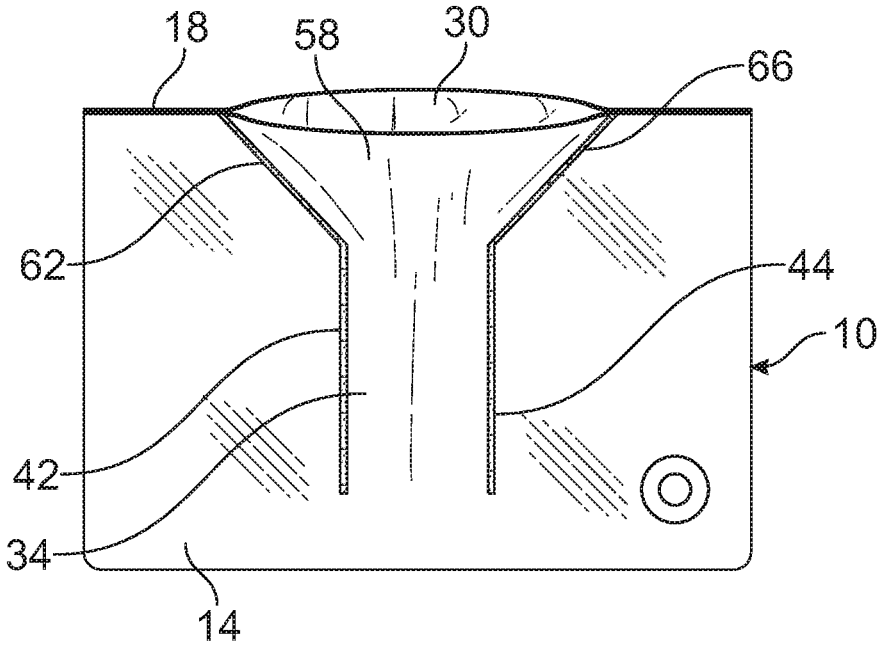
FIG. 5 is a perspective side view of a liner according to an embodiment of the present technology.

FIG. 5 illustrates a liner 10 that is similar to the liner of FIG. 3 except that it includes a larger opening 30 and two diagonal seals 62 and 66 that extend from the top end 18 to the two vertical seals 42 and 44 in order to form a funnel 58 that leads to the passageway 34. The larger opening 30 and funnel 58 can accommodate a variety of differently sized dispenser mouths from which liquid, such as tea or coffee, is poured into the pouch 14.

Figure 6:
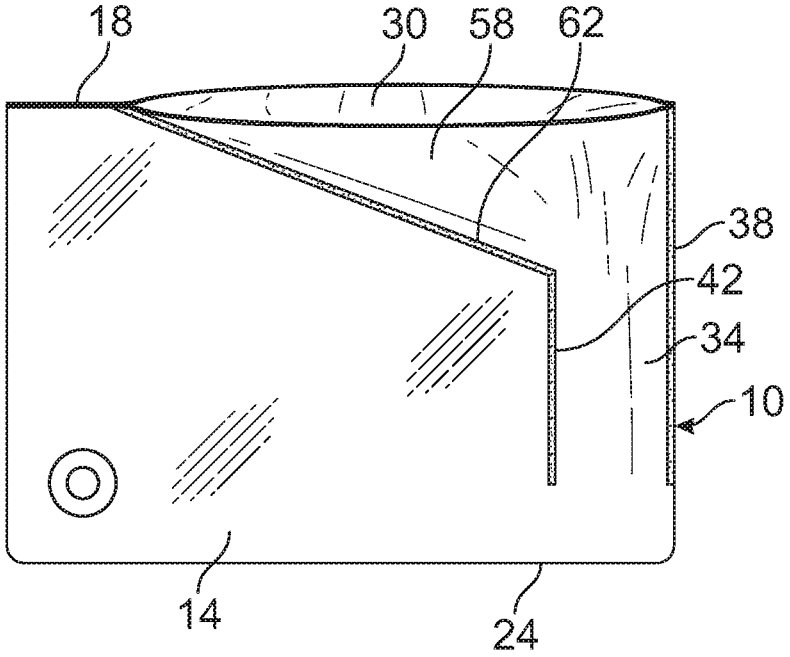
FIG. 6 is a perspective side view of a liner according to an embodiment of the present technology.

FIG. 6 illustrates a liner 10 that includes a sealed top end 18 with a large opening 30 at one side of top end 18. A diagonal seal 62 extends from the top end 18 to an inner side seal 42. The inner side seal 42 extends downward from the bottom of the diagonal seal 62 but does not extend all the way to the bottom 24 of the pouch 14. The opening 30 and the diagonal seal 62 define a funnel 58 that leads to the passageway 34 defined by the inner side seal 42 and an outer side or seal 38 of the liner 10 that extends from the top end 18 of the pouch 10 to the bottom 24 of the liner 10. The larger opening 30 and funnel 58 can accommodate a variety of differently sized dispenser mouths from which liquid, such as tea or coffee, is poured into the pouch 14. Alternatively, the funnel 58 can be located on the other side of the liner 10.

Figure 7:
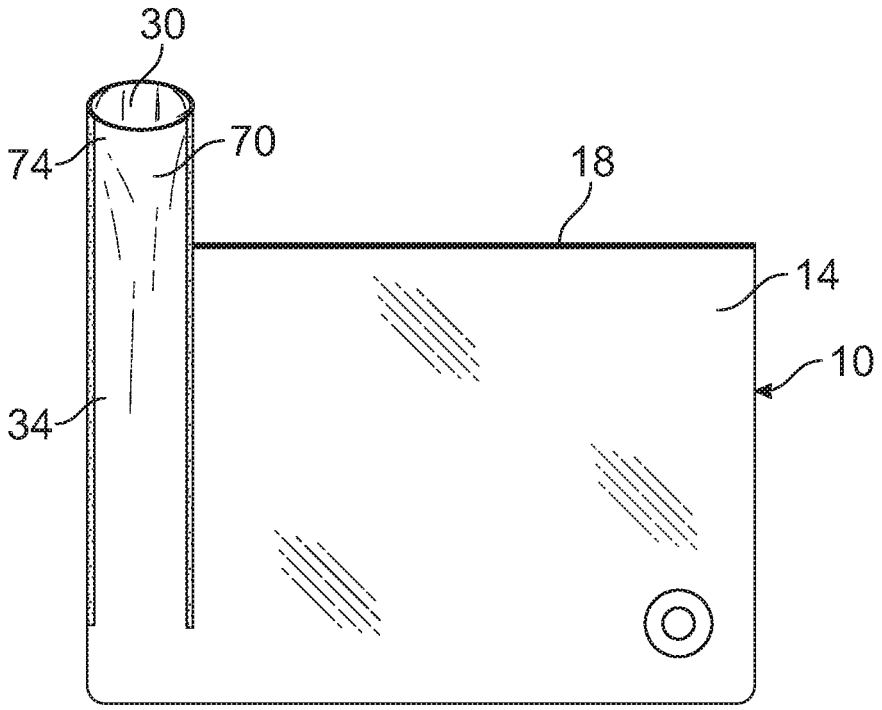
FIG. 7 is a perspective side view of a liner according to an embodiment of the present technology.

FIG. 7 illustrates a liner 10 that is similar to that of FIG. 2 except that the liner 10 includes a hollow tube-shaped flap or neck portion 70 that extends up above the top end 18 of the liner 10. The top of the flap 70 includes an opening 30, and the flap 70 defines a channel 74 extends that downward to, and is in fluid communication with, the passageway 34. After the pouch 14 is placed in a beverage containing vessel and filled with liquid, a user can fold, twist, pinch, and/or tie off or otherwise secure the flap 70 to close off the opening 30. The folded or tied or otherwise closed off flap 70 helps prevent contaminants from getting into the pouch 14 and the liquid in the pouch 14. Alternatively, the funnel flap 70 can be located on the other side of the liner 10 or somewhere between each of the sides of the liner 10.

Figure 8A:
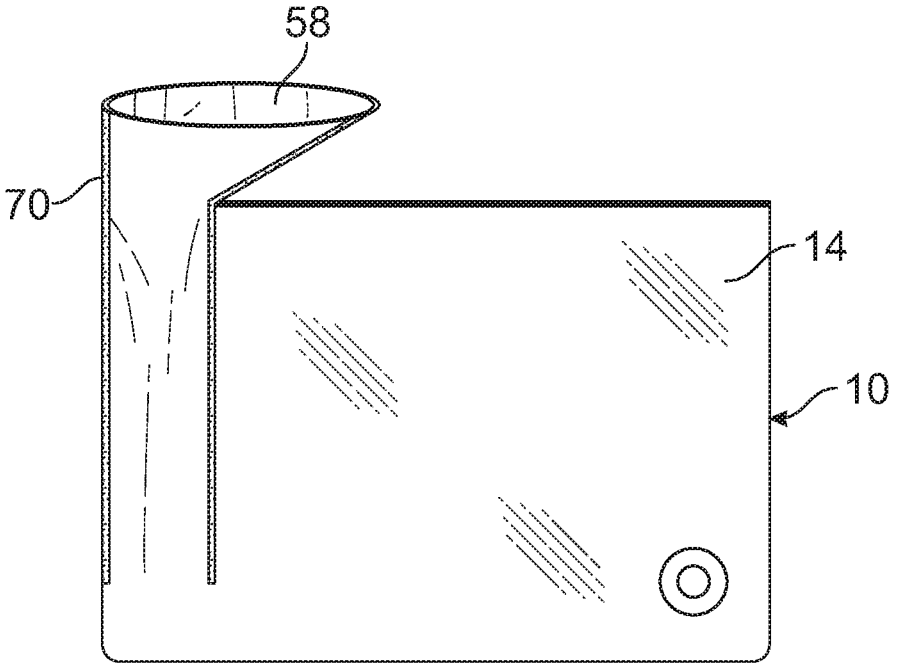
FIG. 8*a* is a perspective side view of a liner according to an embodiment of the present technology.
Figure 8B:
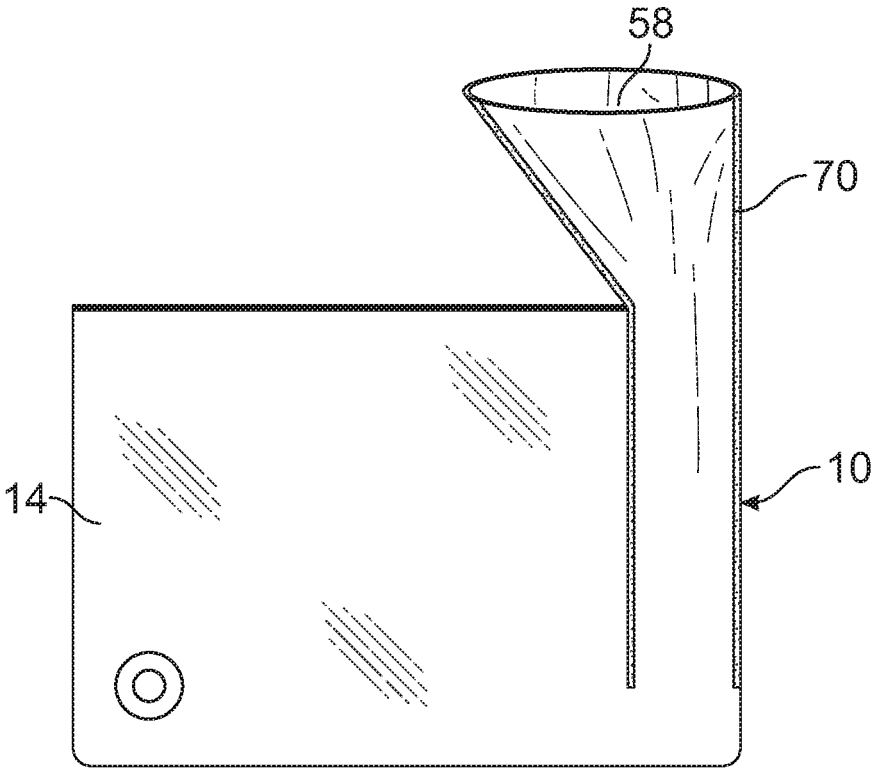
FIG. 8*b* is a perspective side view of a liner according to an embodiment of the present technology.

FIGS. 8*a* and 8*b* illustrate alternative versions of a liner 10 that is similar to the liner 10 of FIG. 7 except that the flap 70 is funnel-shaped instead of tube shaped. The funnel 58 can accommodate very large dispenser mouths from which liquid, such as coffee or tea, is poured into the pouch 14. Like the flap 70 of the liner 10 of FIG. 7, the funnel-shaped flap 70 can be folded or tied or otherwise closed off after the pouch 14 is filled with liquid in order to help prevent contaminants from getting into the pouch 14 and the liquid in the pouch 10. Alternatively, the flaps 70 of the liners 10 of FIGS. 8*a* and 8*b* can be located in different places on the liners 10 with respect to the spouts.

Figure 9:
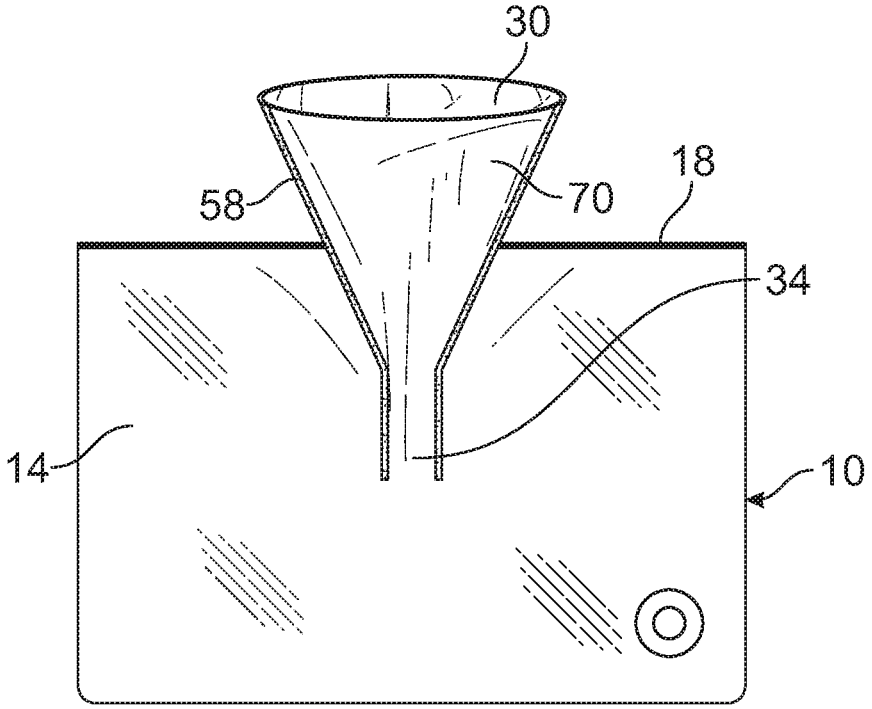
FIG. 9 is a perspective side view of a liner according to an embodiment of the present technology.

FIG. 9 illustrates a liner 10 that is similar to the liner of FIG. 5 except that the liner 10 includes a funnel shaped flap 70 that extends up above the top end 18 of the pouch 14. The top of the flap 70 includes the opening 30, which leads to the funnel 58, and the funnel 58 extends downward to, and is in fluid communication with, the passageway 34 in the center of the pouch 14. Like the flap 70 of the embodiment of FIG. 7, the funnel flap 70 can be folded or tied or otherwise closed off after the pouch 14 is filled with liquid in order to help prevent contaminants from getting into the pouch 14 and the liquid in the pouch 14.

Figure 10A:
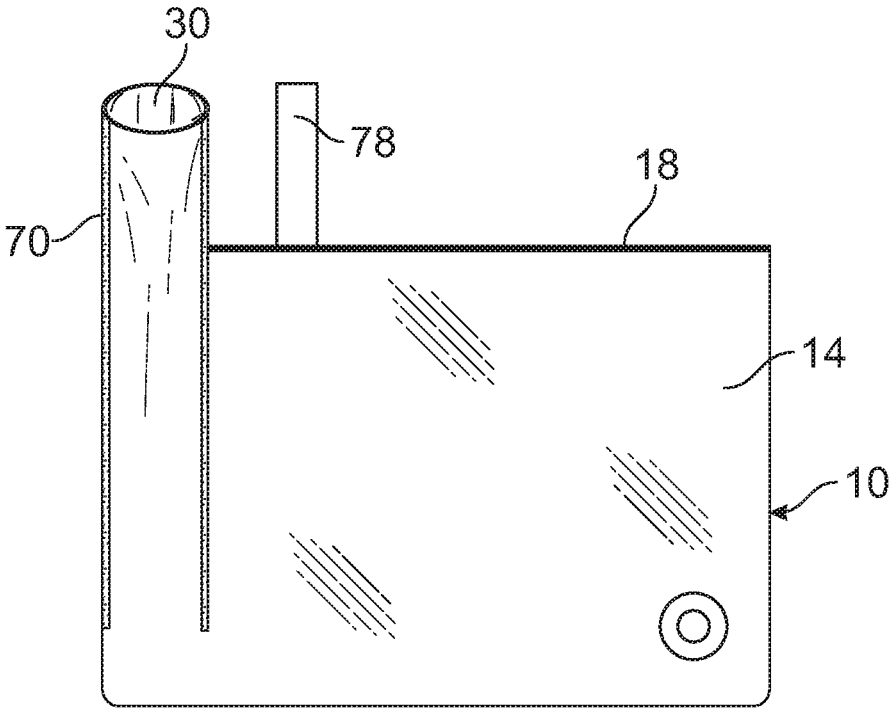
FIG. 10*a* is a perspective side view of a liner according to an embodiment of the present technology.
Figure 10B:
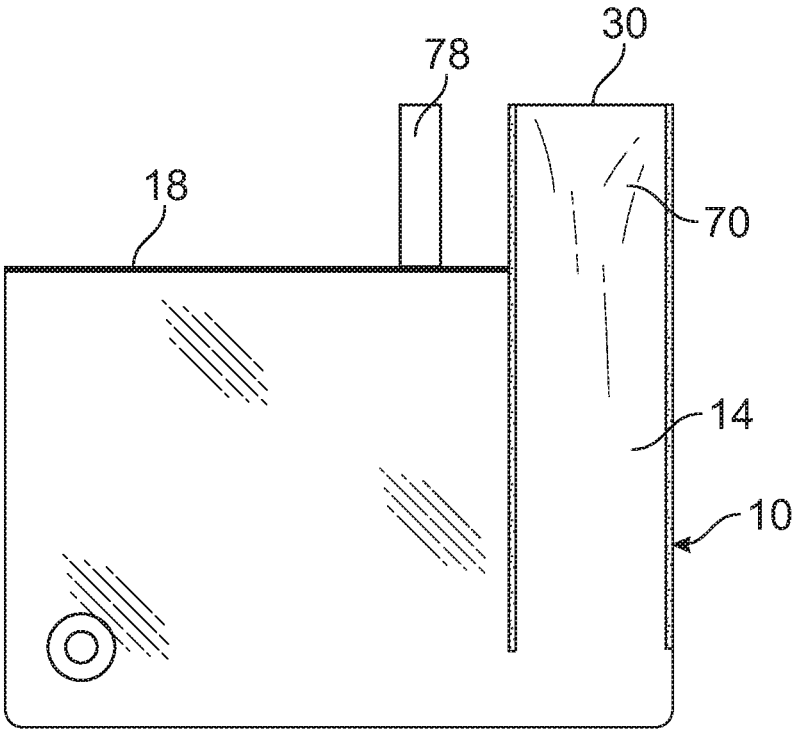
FIG. 10*b* is a side view of a liner according to an embodiment of the present technology.
Figure 10C:
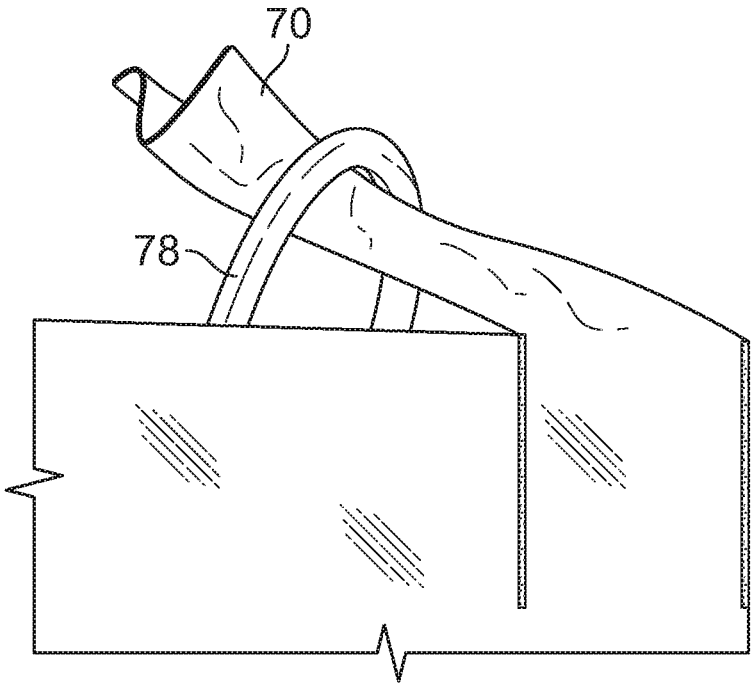
FIG. 10*c* is a partial side view of the liner of FIG. 10*b* being tied closed.
Figure 11A:
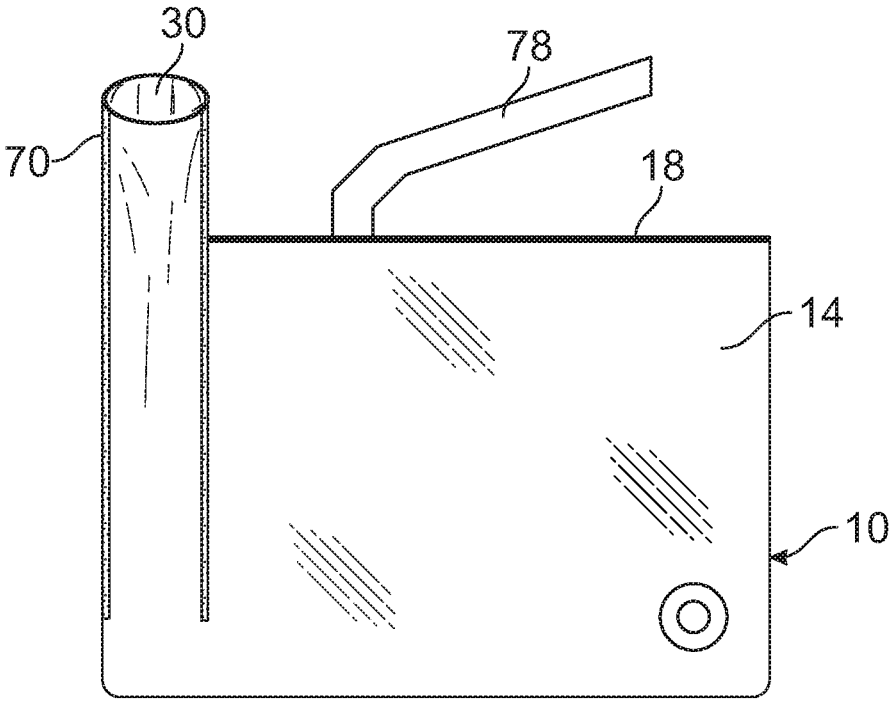
FIG. 11*a* is a perspective side view of a liner according to an embodiment of the present technology.
Figure 11B:
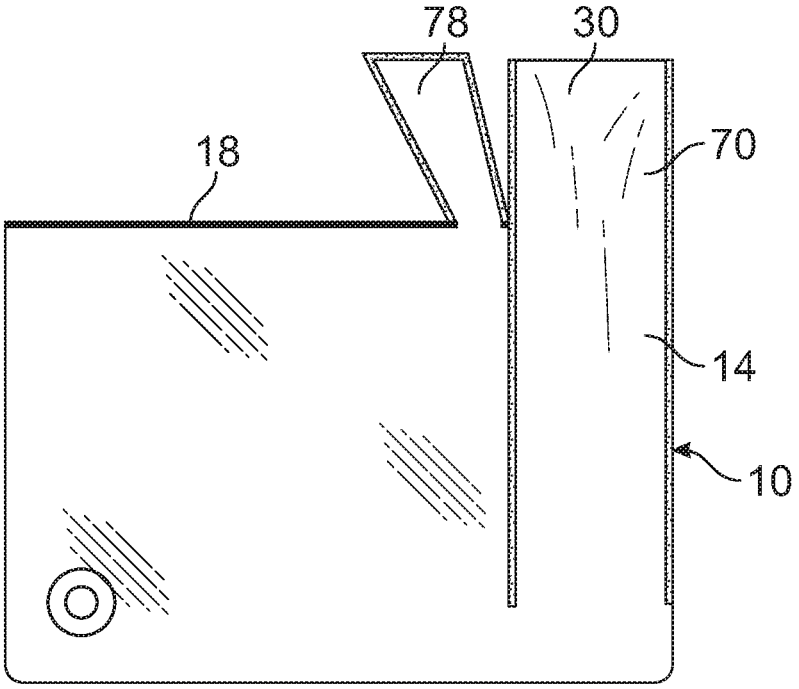
FIG. 11*b* is a side view of a liner according to an embodiment of the present technology.

FIGS. 10*a*-10*c* and 11*a*-11*b* illustrate embodiments of liners 10 that are similar to the liner 10 of FIG. 7 except that the liners 10 include an additional second flap or strip 78 that extends up from the sealed top end 18 of the liner 10 proximate the tube shaped flap 70. The second flap 78 can be a piece of plastic that extends from the top end 18, and, as shown in FIG. 10*c*, it can be used to tie off the tube shaped flap 70 after liquid has been poured into the pouch 14 through the opening 30 in the tube shaped flap 70. Tying off the flap 70 with the second flap 78 helps prevent contaminants from getting into the pouch 14 and the liquid in the pouch 14.

Figure 12:
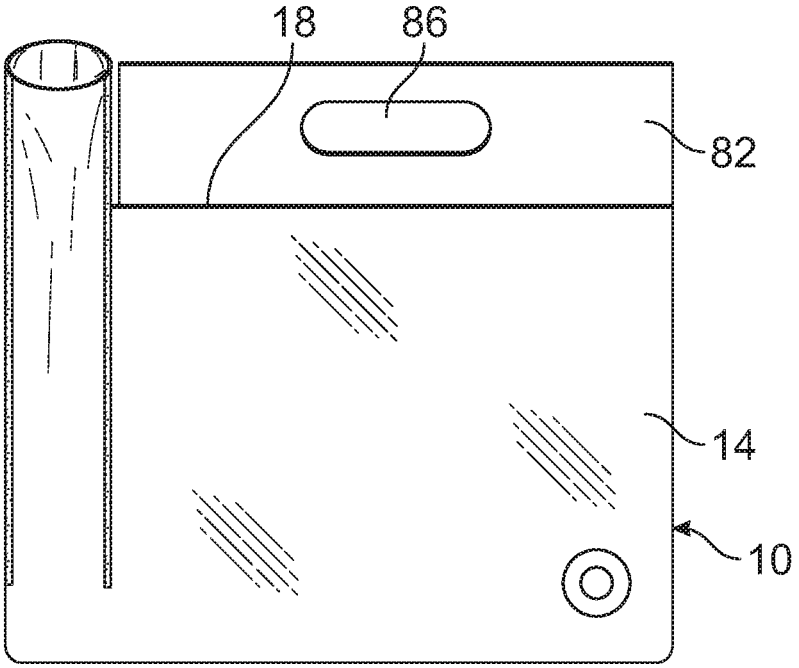
FIG. 12 is a perspective side view of a liner according to an embodiment of the present technology.

FIG. 12 illustrates a liner 10 that is similar to the liner 10 of FIG. 7 except that the liner 10 includes the additional feature of a rectangular handle flap 82 that extends along the sealed portion of the top end 18 of the pouch 14. The handle flap 82 may be made of the same material as the liner 10 (e.g., plastic) and be formed integrally with the liner 10. Alternatively, the handle flap 82 may be made separately from the liner 10 and/or made of a different material than the liner 10 (e.g., cardboard or a different kind of plastic) and then connected to the liner 10. The rectangular flap 82 includes a handle opening 86 so that the handle flap 82 can be used as a handle to carry the pouch 14. Alternatively, the handle flap 82, and/or its opening 86, can have different shapes and sizes than those shown in FIG. 12 and be in different locations on the liner 10.

Figure 13B:
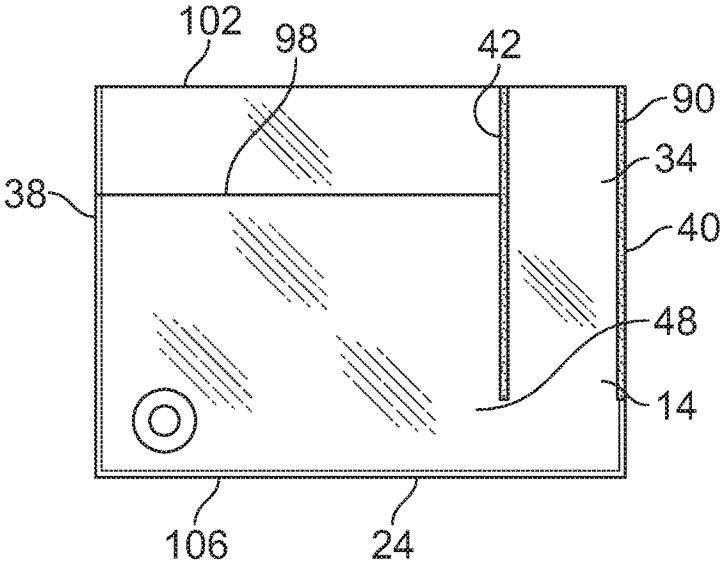
FIG. 13*b* is a side view of the liner of FIG. 13*a* with a heat seal added.
Figure 13A:
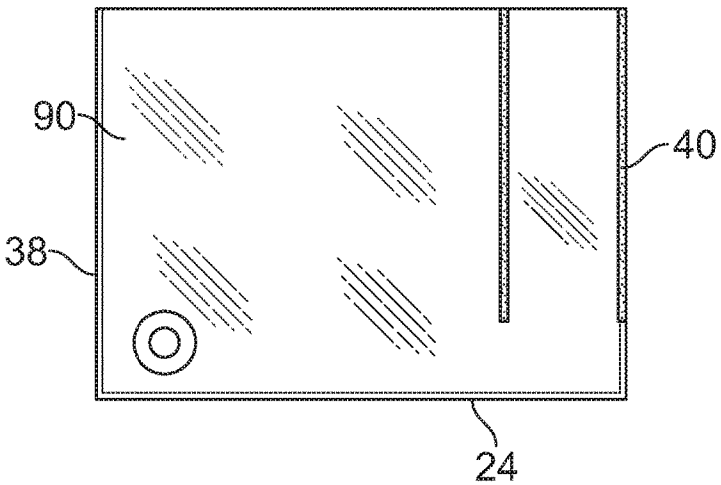
FIG. 13*a* is a side view of an unfinished liner according to an embodiment of the present technology.
Figure 13C:
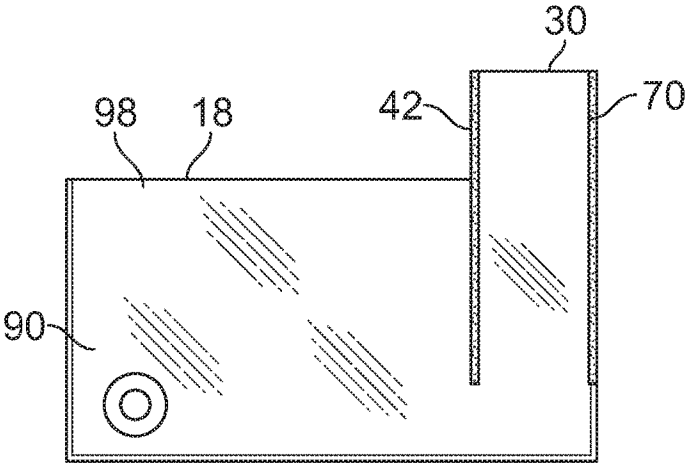
FIG. 13*c* is a side view of the liner of FIG. 13*a* with a top strip removed.
Figure 13E:
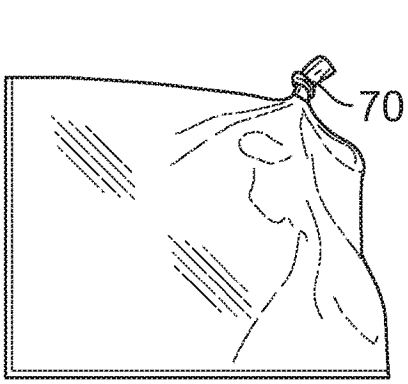
FIG. 13*e* is a side view of the liner of FIG. 13*a* tied off.
Figure 13D:
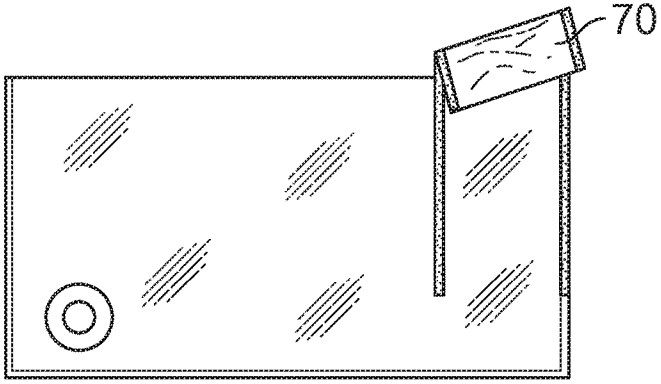
FIG. 13*d* is a side view of the liner of FIG. 13*a* with the flap folded down.

FIGS. 13*a-e* illustrate a method for making and using a pouch 14 like the one shown in FIG. 7, although similar techniques could be used to make and use any number of other liner 10 embodiments, including those shown in other figures herein. FIGS. 13*a* and 13*b* show a rectangular plastic film portion 90. The portion 90 includes sealed sides 38 and 40 and a sealed bottom 24. The film portion 90 can have another heat seal added thereto to create a top seal 98 that extends parallel to the bottom seal 24 and that is positioned between top and the bottom ends 102 and 106 of the film portion 90. The top seal 98 extends from the left side seal 38 to an inner side seal 42 that, with the right side seal 40, defines a passageway 34 into the interior region 48 of the pouch 14. With reference to FIG. 13*c*, the film portion 90 is cut or trimmed just above the top seal 98 and just to the left of the inner side seal 42 to define a pouch 14 having a partially sealed top end 18 and a tube shaped flap 70 with an opening 30. The pouch 14 can be placed in a beverage urn and filled with liquid through the opening 30 in the tube shaped flap 70. After the pouch 14 is filled with liquid, and with reference to FIGS. 13*d-e*, the flap 70 can then be folded or tied or otherwise closed off to help prevent contaminants from getting into the pouch 14 and the liquid in the pouch 14.

Figure 14A:
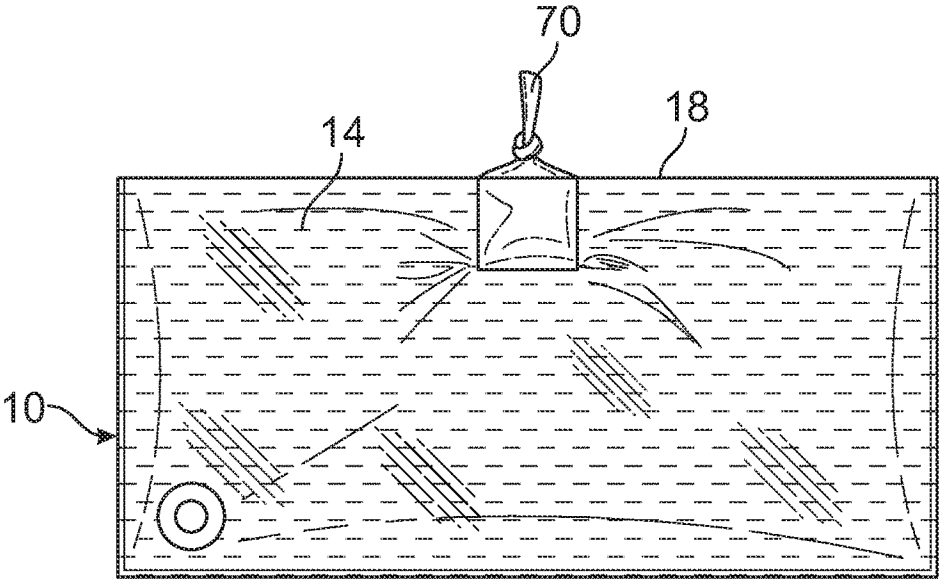
FIG. 14*a* is a side view of a liner according to an embodiment of the present technology.
Figure 14B:
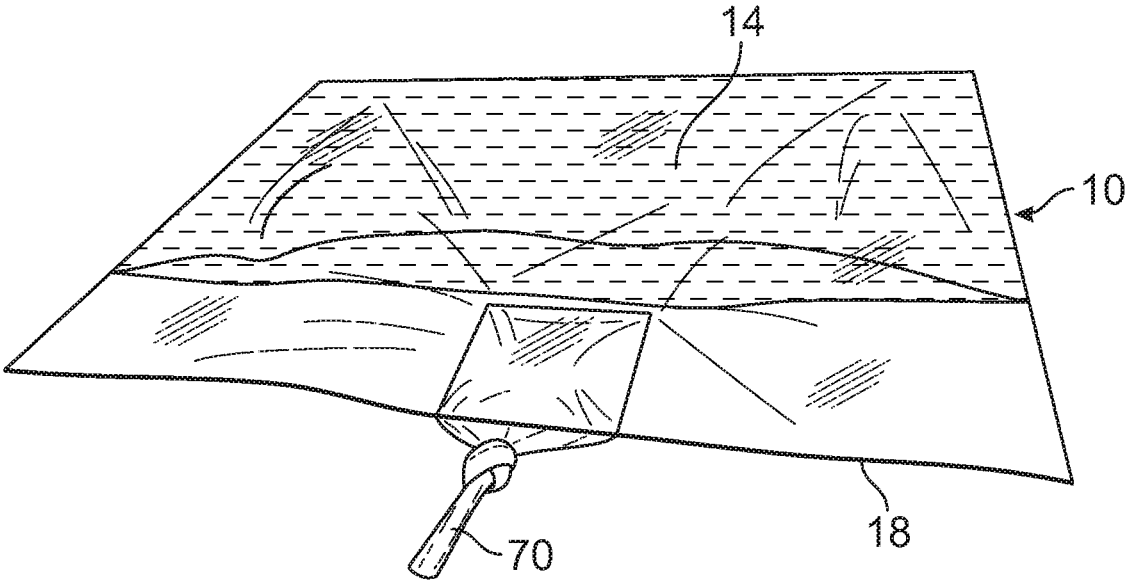
FIG. 14*b* is a top perspective view of the liner of FIG. 14*a*.

FIGS. 14*a*-14*b* illustrate another embodiment of a liner 10 filled with liquid. The liner 10 includes a top tube-shaped flap 70 that is generally located at the center of the top end 18 of the pouch 14 and extends up above the top end 18. After the pouch 14 is filled with liquid, the flap 70 can be tied off as shown in FIGS. 14*a*-14*b*. The liquid-filled liner 10 can then be stored in a refrigerator to be later placed in a vessel or it can be put right into the vessel after being filled and tied off. In this way, the liner 10, like the other liner embodiments that include a tie-flap, can be pre-filled and stored until a liner that is already in the beverage dispensing vessel is emptied or needs replacement.

Figure 15:
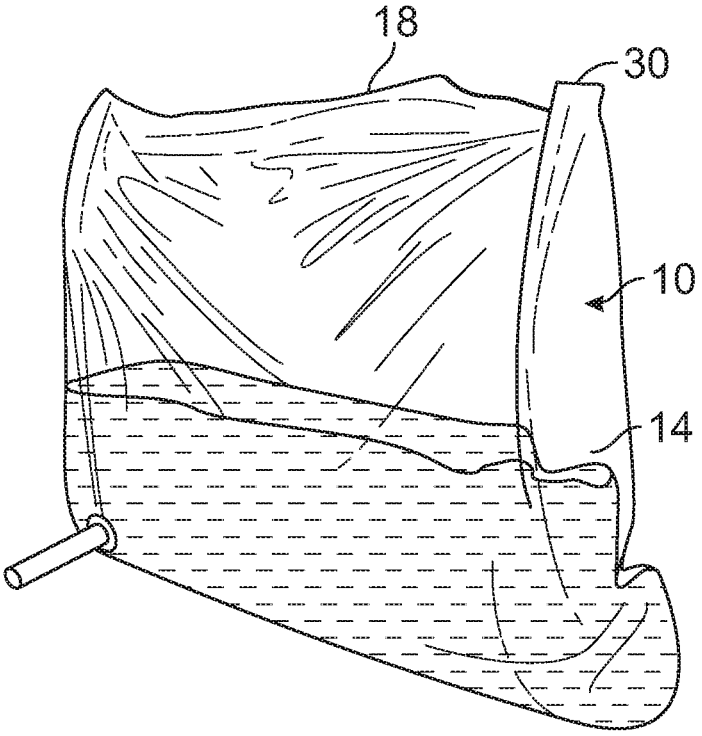
FIG. 15 is a side perspective view of a liner according to an embodiment of the present technology filled with liquid and with the opening closed off.

FIG. 15 illustrates a liner 10 similar to the one shown in FIG. 8B that is filled with liquid. The opening 30 at the top end of the pouch 14 is tied or otherwise closed off. Because the top end 18 of the pouch is closed off, the pouch 14 can be laid on its side. This allows the filled pouch 14 to be easily adjusted, transported, or placed in areas besides the interior of a beverage urn, such as a refrigerator, without the user having to be concerned about liquid leaking out of the filled pouch 14.

Figure 24:
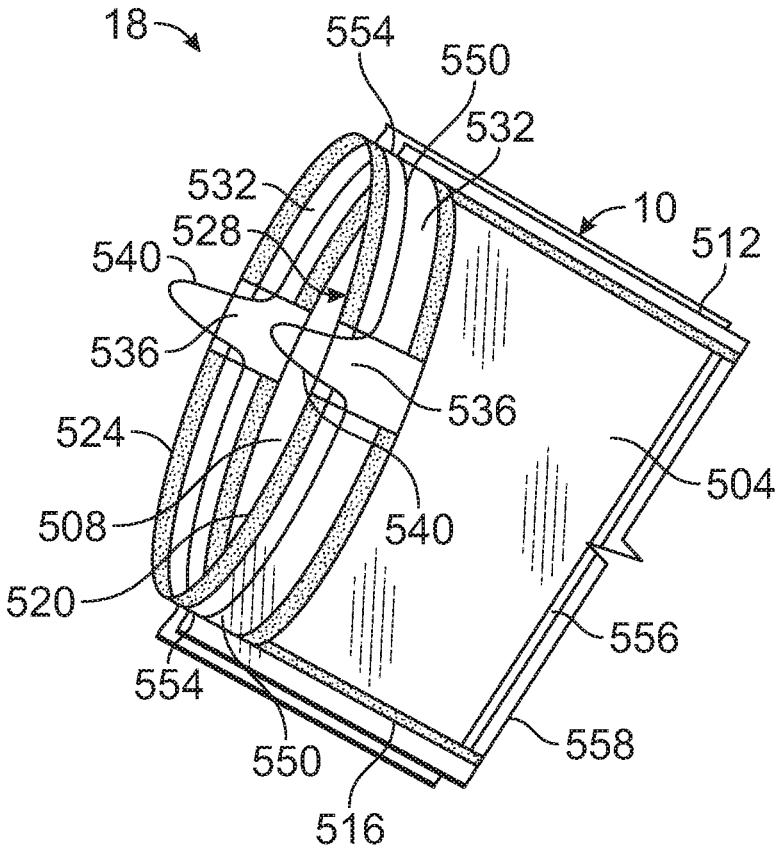
FIG. 24 illustrates a side perspective view of a top portion of a liner according to an embodiment of the present technology.

Alternatively, and as shown in FIG. 24, the top end 18 of the liner 10 can have a drawstring that can be used to close or partially close off the top end 18. In that regard, the liner 10 includes front and rear panels 504 and 508 that are sealed together along first and second sides 512 and 516 of the liner 10. The panels 504 and 508 include top ends 520 and 524 that define an opening 528 at the top end 18 of the liner 10. The top ends 520 and 524 each include a channel 532. Each channel 532 is connected to a gap 536 along the center of the top end 520, 524 of the panel 504, 508. A drawstring 540 is located and secured in each channel 532. Each drawstring 540 has ends 550 that are secured at opposite ends 554 of the channel 532. A user can access the drawstring 540 in each channel 532 through the gap 536. The bottom of the liner 10 is defined by a seal 556, and the film of the liner 10 includes a bottom edge 558 below the seal 556 that was previously a perforated edge before the liner 10 was removed from a roll of film. The perforated edge 558 allows the liner 10 to be cut, torn, or otherwise separated from another adjacent liner 10 in the roll of film from which the liners 10 are made.

In operation, a user can fill the liner 10 with liquid through the opening 528 and then pull each drawstring 540 upward through the gap 536 to shorten the top ends 520 and 524 of the panels 504 and 508 and close or mostly close the opening 528 at the top end 18 of the liner 10. The user can tie together the portions of the two drawstring 540 extending out of the gaps 536 to keep the opening 528 closed. The process of closing the opening 528 by pulling the drawstrings 540 can be done before or after the liner 10 is placed in a beverage urn. In addition, the user can pull the top ends 520 and 524 of the two panels 504 and 508 away from each other in order to pull the drawstrings 540 back into the channels 532 and re-open the opening 528. The drawstrings 540 can be used with liners that include more than a front and rear panel. For example, drawstrings 540 can be used with a liner that includes a front panel, a rear panel, and two side panels.

Figure 25:
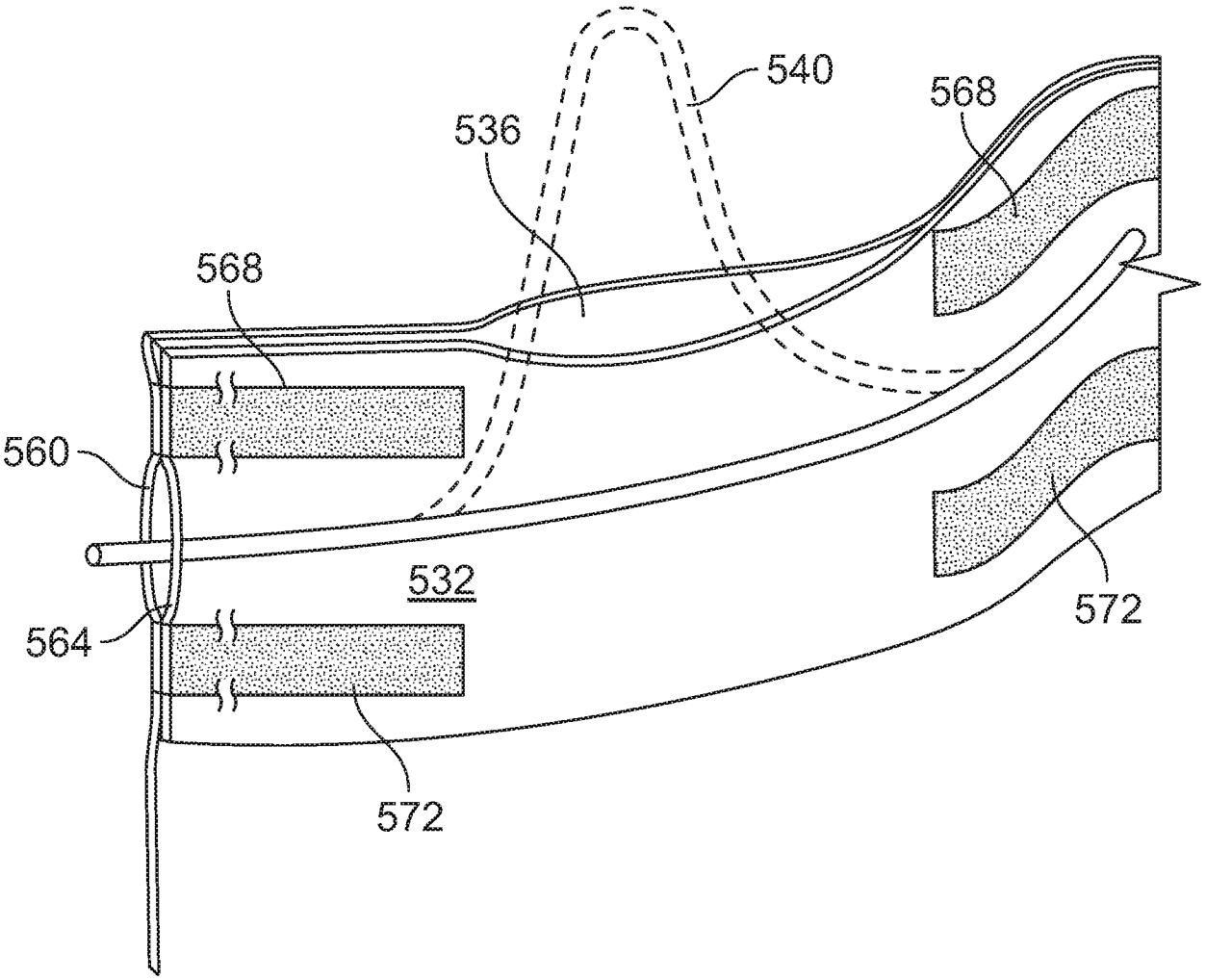
FIG. 25 illustrates a side perspective view of a top portion of a liner according to an embodiment of the present technology.

FIG. 25 shows the drawstring 540 and channel 532 in more detail. The channel 532 is defined by two separate plies of film, an inner ply 560 and an outer ply 564. The film is the same film from which the panels 504 and 508 are made. The inner ply 560 may just be an extension of the panel 504 or 508. The inner and outer plies 560 and 564 are sealed together with two top seals 568 and two bottom seals 572. The top of the channel 532 is defined by the two top seals 568, and the bottom of the channel 532 is defined by the two bottom seals 572. The drawstring 540 is located in the channel 532 between the set of top seals 568 and the set of bottom seals 572. The gap 536 is located between the two top seals 568 and between the inner and outer plies 560 and 564. Alternatively, the channel 532 can be defined by different numbers or types of seals or connections between the plies 560 and 564.

Figure 26:
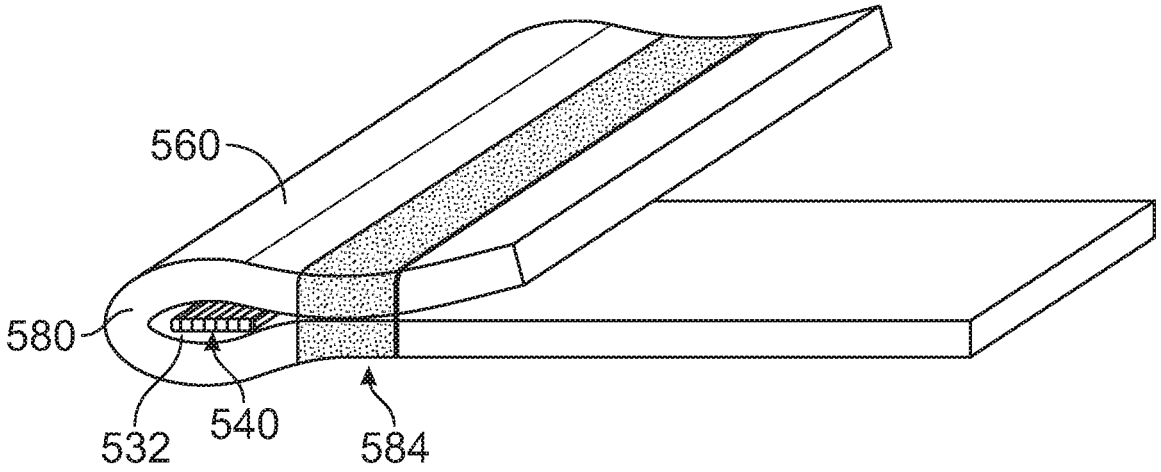
FIG. 26 illustrates a partial side perspective view of a top portion of a liner according to an embodiment of the present technology.
Figure 27:
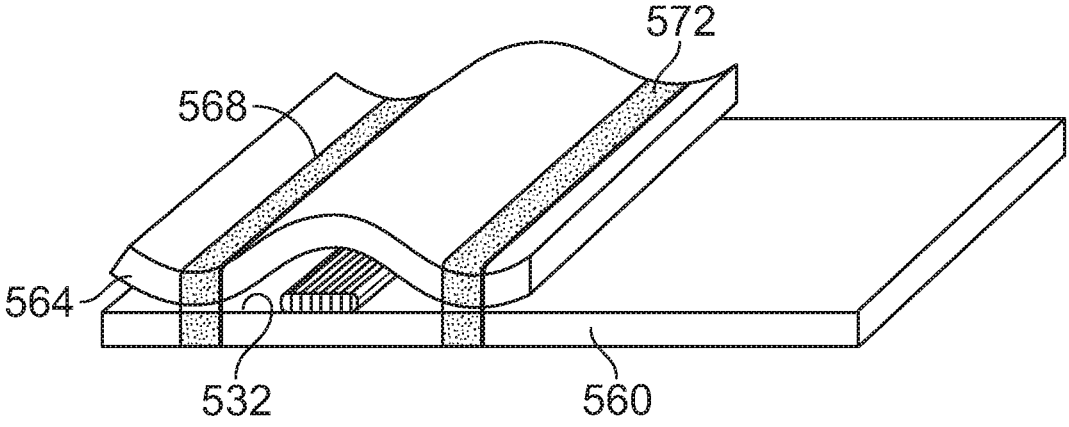
FIG. 27 illustrates a partial side perspective view of a top portion of a liner according to an embodiment of the present technology.

FIGS. 26 and 27 illustrate two different alternative ways to make the channel 532 of the liner 10 of FIG. 24. FIG. 26 illustrates a channel 532 defined by a single ply 560 of film that is folded over itself. The top of the channel 532 is defined by the fold 580, and the bottom of the channel 532 is defined by a seal 584 that connects the folded-over ply 560 to itself. The ply 560 can be an extension of a panel of the liner 10. The drawstring 540 is located and secured in the channel 532. FIG. 27 illustrates the channel 532 defined by the inner ply 560 and the outer ply 564 and by a top seal 568 and bottom seal 572 between the two plies 560 and 564. The inner ply 560 may just be an extension of the panel 504 or 508 of the liner 10. The channel 532 is constructed in a way similar to the channel 532 shown in FIG. 25. Alternatively, the outer play 564 could be an extension panel 504 or 508 and the inner ply 560 could be a separate smaller ply of film.

The liners 10 of the various embodiments include a partially sealed top end and an opening at the top end through which liquid, and in particular, liquid beverages, such as iced tea or coffee, can be poured when the liners are positioned in a beverage urn or vessel. By including a partially sealed top end, the liners help reduce the risk of the person adding a substance to the liner contaminating the liquid. This partially sealed top end also helps prevent customers using the beverage system from contaminating the liquid in the pouch when it is in the urn or when it is being transported to the urn. In that regard, if the urn cover were to fall off or a user were to remove the cover on the urn, the user would not be able to expose an entire open end of the pouch to the environment or easily be able to add anything to the liquid in the pouch because the top of the pouch is mostly sealed. In addition, by including a partially sealed top end, the liner embodiments require less film than conventional liners because the liners do not need excess film to be folded over the top edge of the urn. In this way, the liners of the various embodiments are cheaper and more efficient than conventional liners.

Moreover, the liner embodiments that include flaps that extend up above the sealed top end of the liner and that can be folded or tied after liquid is poured into the pouch include the benefit of being re-closable. By being re-closable, the liners further help prevent contaminants from getting into the interior region of the pouch or the liquid in the pouch. The tied, twisted, folded or otherwise closed flaps of some of the re-closable liner embodiments also make it easier to adjust, transport, and/or store filled pouches because the closed off flaps help prevent liquid from escaping or leaking out of the pouch after the pouch has been filled. For example, the tied or closed off pouches can be prepared and stored in a refrigerator or a bin before being inserted into a beverage urn to replace a previous liquid filled liner. This enables more efficient replacement of liquid beverages in an urn. In addition, the flaps of some of the liner embodiments can also be used as a handle to more easily transport filled or unfilled pouches.

Figure 16A:
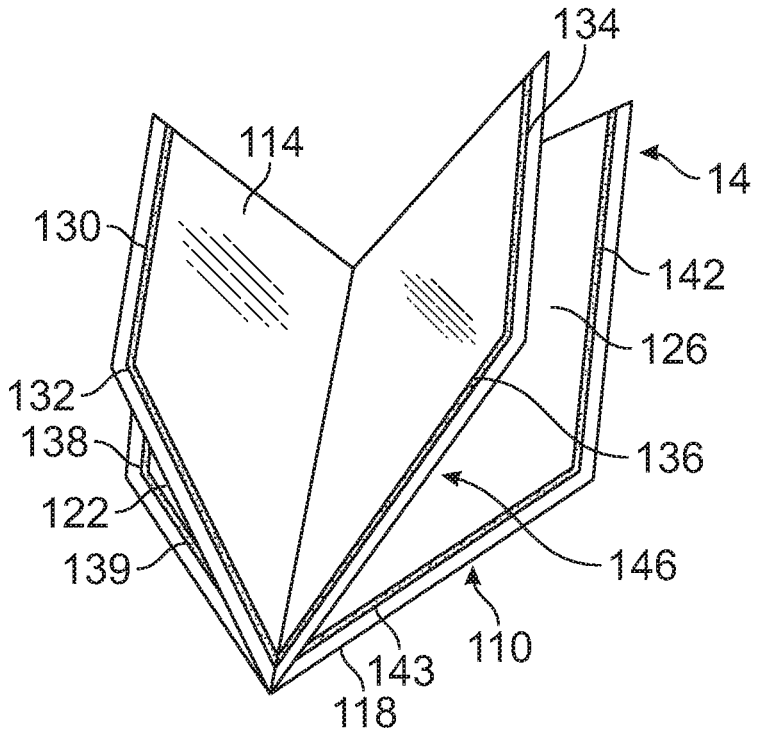
FIG. 16*a* is a bottom perspective view of a liner bottom according to an embodiment of the present technology.

FIG. 16*a* illustrates a bottom portion 110 of a liner pouch 14 according to an embodiment of present invention. The pouch 14 has a front panel 114, a rear panel 118, a first side panel 122, and a second side panel 126. The front, rear, and side panels 114, 118, 122, and 126 all include a triangular bottom portion and the side panels 122 and 126 are folded inward, or gusseted. The front panel 114 is connected to the first side panel 122 by a first vertical seal 130 and a first diagonal seal 132 and to the second side panel 126 by a second vertical seal 134 and a second diagonal seal 136. The rear panel 118 is connected to the first side panel 122 by a third vertical seal 138 and a third diagonal seal 139 and to the second side panel 126 by a fourth vertical seal 142 and a fourth diagonal seal 143.

Figure 22A:
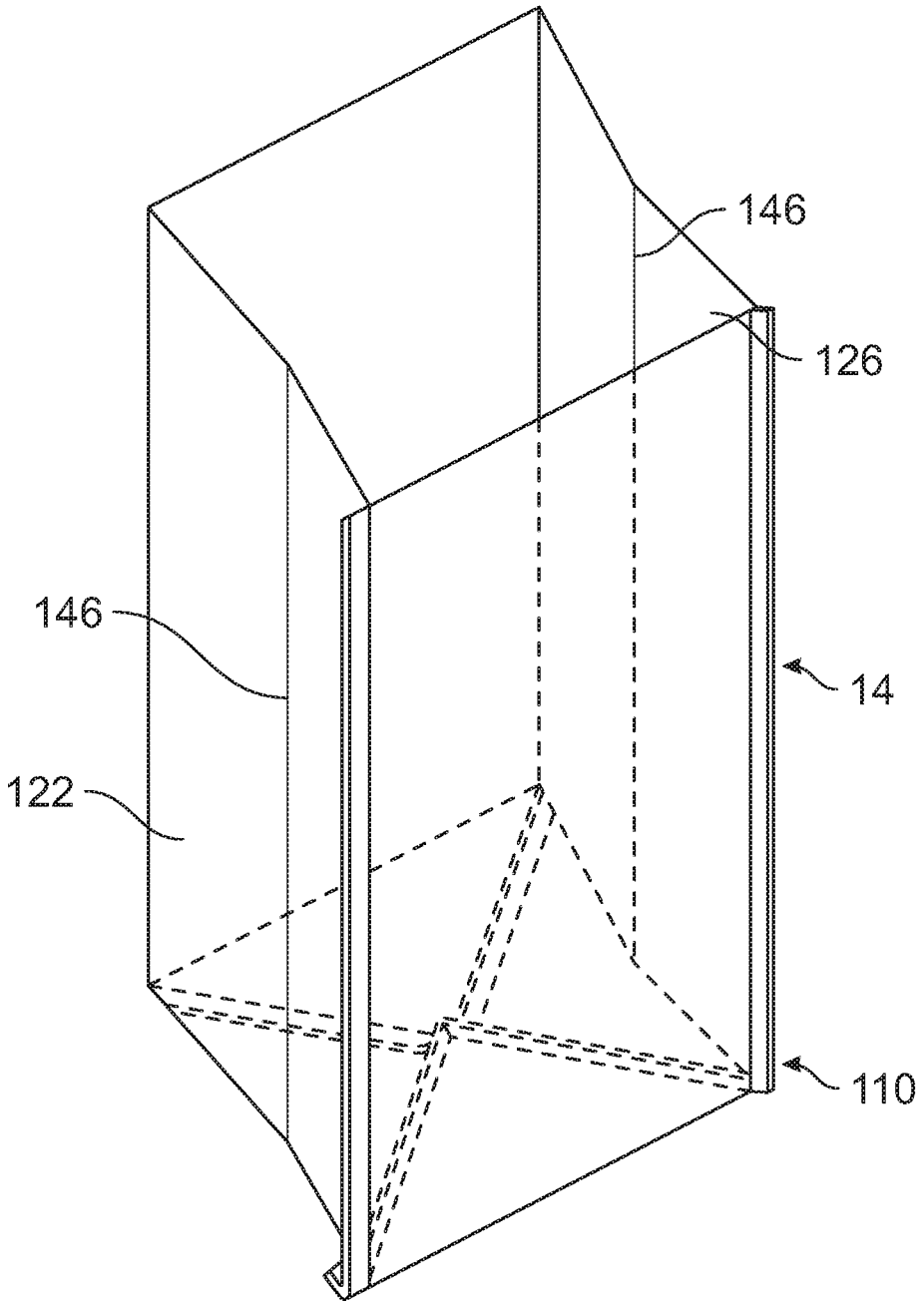
FIG. 22*a* illustrates a top perspective view of a liner according to an embodiment of the present technology.
Figure 22B:
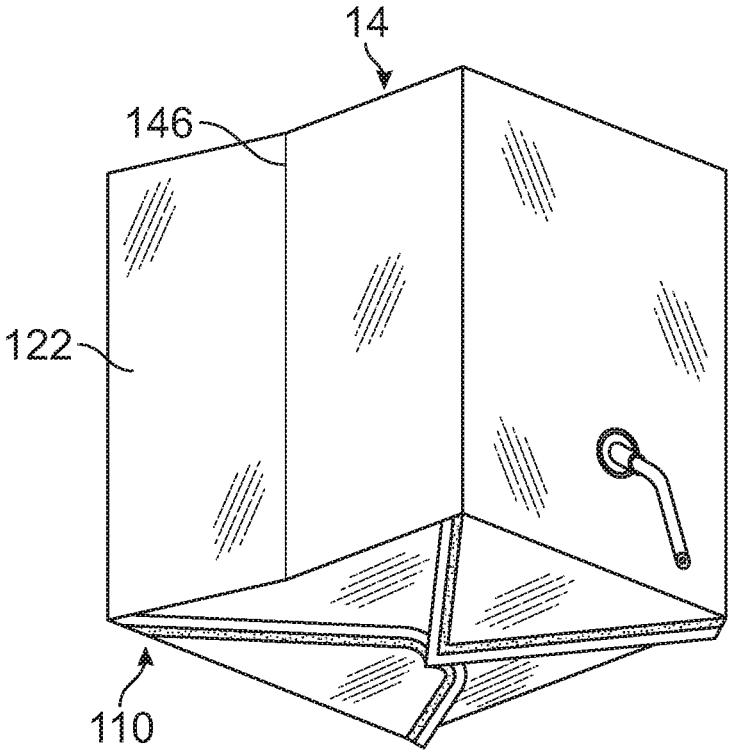
FIG. 22*b* illustrates a bottom perspective view of a liner according to an embodiment of the present technology.
Figure 22C:
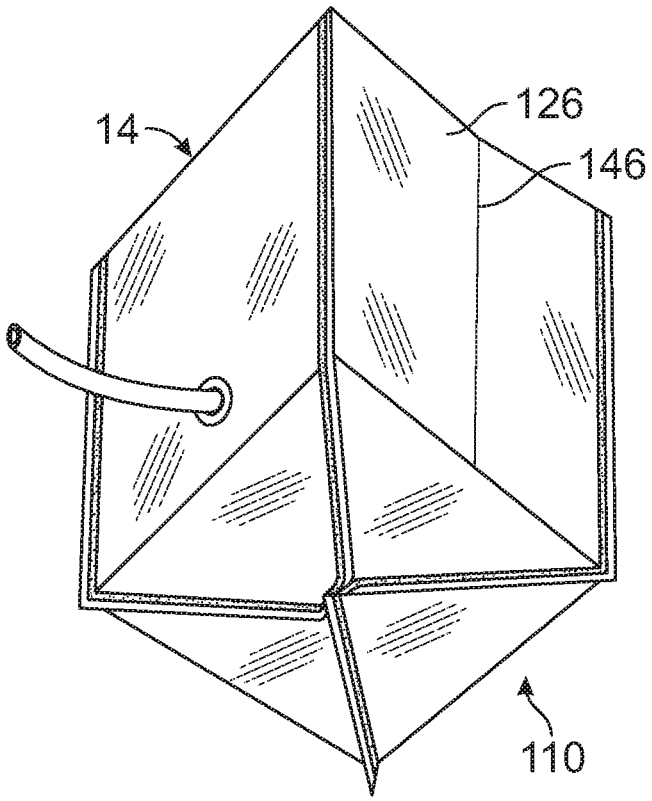
FIG. 22*c* illustrates a bottom perspective view of a liner according to an embodiment of the present technology.

As shown in FIGS. 22*a-c*, the gussets 146 in the side panels 122 and 126 and the triangular shape of the bottom portion 110 allow the bottom portion 110 of the pouch 14 to be folded such that it forms a generally flat and square bottom. Thus, when the pouch 14 is filled with liquid, the gusseted side panels 122 and 126 naturally flex out to form a square shape along the bottom portion 110 of the pouch 14.

Figure 23:
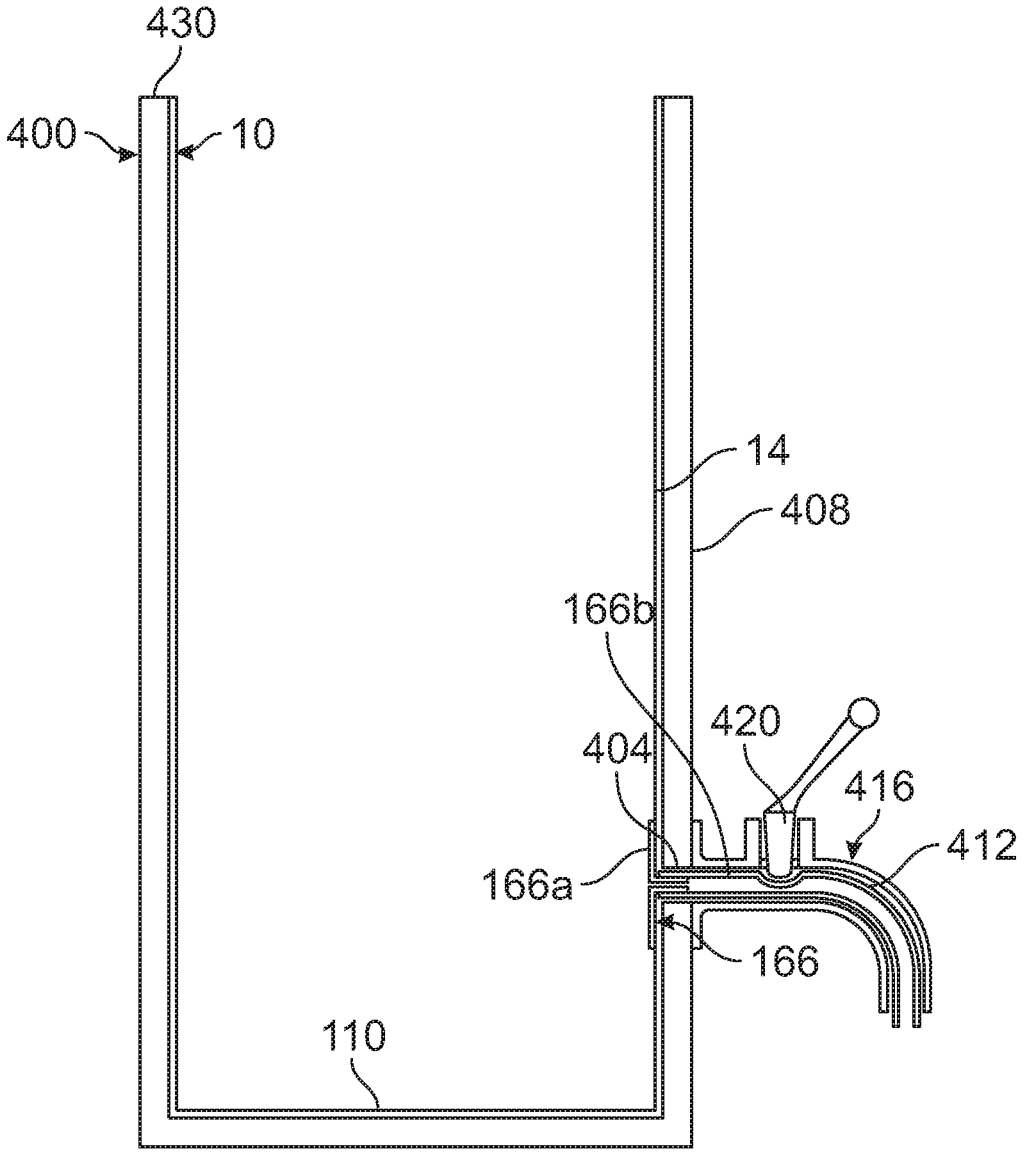
FIG. 23 illustrates a cutaway side view of a liner positioned in a beverage urn according to an embodiment of the present technology.

As shown in FIG. 23, the flat square bottom portion 110 of the expanded gusseted pouch 14 is configured to fit and rest in the bottom of a rectangular or square beverage urn 400. Thus, the gusseted urn liner 10 better utilizes the space of a rectangular beverage urn than conventional pouches that have rounded or pillow shaped bottom section. It will be understood that the pouch 14 can be folded into the square bottom shape and will remain in that shape regardless of whether the pouch 14 is filled with liquid. The liner 10 includes a fitment 166 that includes a spout or tube adapter 166*a* connected to the pouch 14. The connection to the pouch 14 may be by a heat seal. The fitment 166 includes a flexible dispensing tube 166*b* that is connected to the spout 166*a*. The tube 166*b* can be removably connected to the spout 166*a* or formed integrally with the spout 166*b*. The tube 166*b* extends through a hole 404 in the wall 408 of the urn 400 and through the bore 412 of a dispensing spigot 416 connected to the wall 408 of the urn 400. The spigot 416 includes a valve 420 that can be adjusted to close off or open the tube 166*b* to control the dispensing of liquid from the liner 10 out of the tube 166*b*. The liner 10 can be folded over the top edge 430 of the urn 400 or it can include a partially sealed or reclosable top portion like those shown in previous embodiments herein. A lid can be placed on top of the urn 400.

Figure 16B:
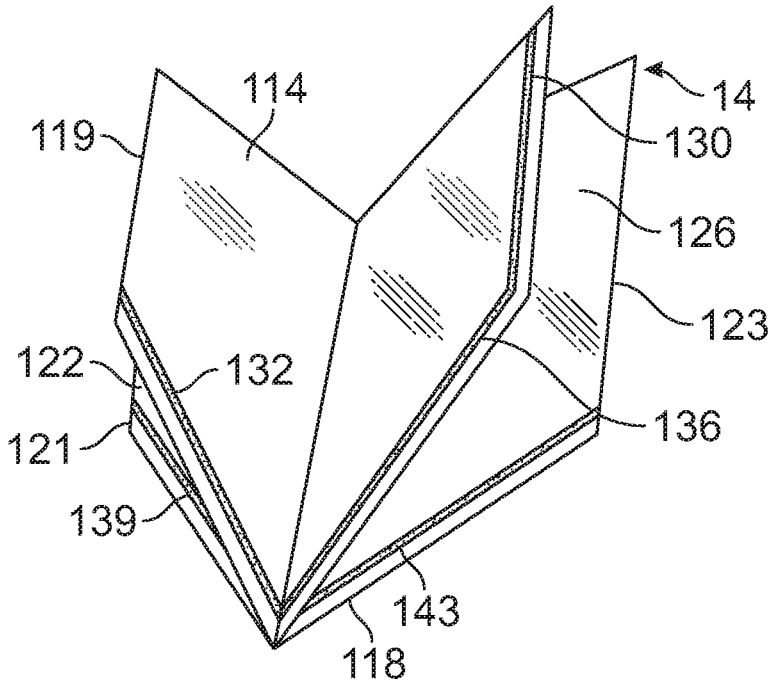
FIG. 16*b* is a bottom perspective view of a liner bottom according to an embodiment of the present technology.

Alternatively, and as shown in FIG. 16*b*, instead of being formed from four separate panels that are sealed together by four vertical seals, the pouch 14 can be formed from a single sheet of film that can be folded to define the four panels 114, 118, 122, and 126 and that requires only one vertical seal 130. By way of example, the vertical seal 130 can be between the front panel 114 and one of the side panels 122 and 126. The front panel 114 can be connected to the other side panel 122 and 126 by a fold 119, and the rear panel 118 can be connected to the side panels 122 and 126 by folds 121 and 123 respectively. Because the film from which the pouch 14 is made is an open tube, the pouch 14 includes bottom diagonal seals 132, 136, 139, and 143 that seal off the bottom portion 110 of the pouch. In yet another embodiment, one panel, such as the front panel 114, can be made separately from the other three panels and connected to two of the other three panels by two vertical seals so that the pouch only has two vertical seals and two vertical folds.

Figure 17:
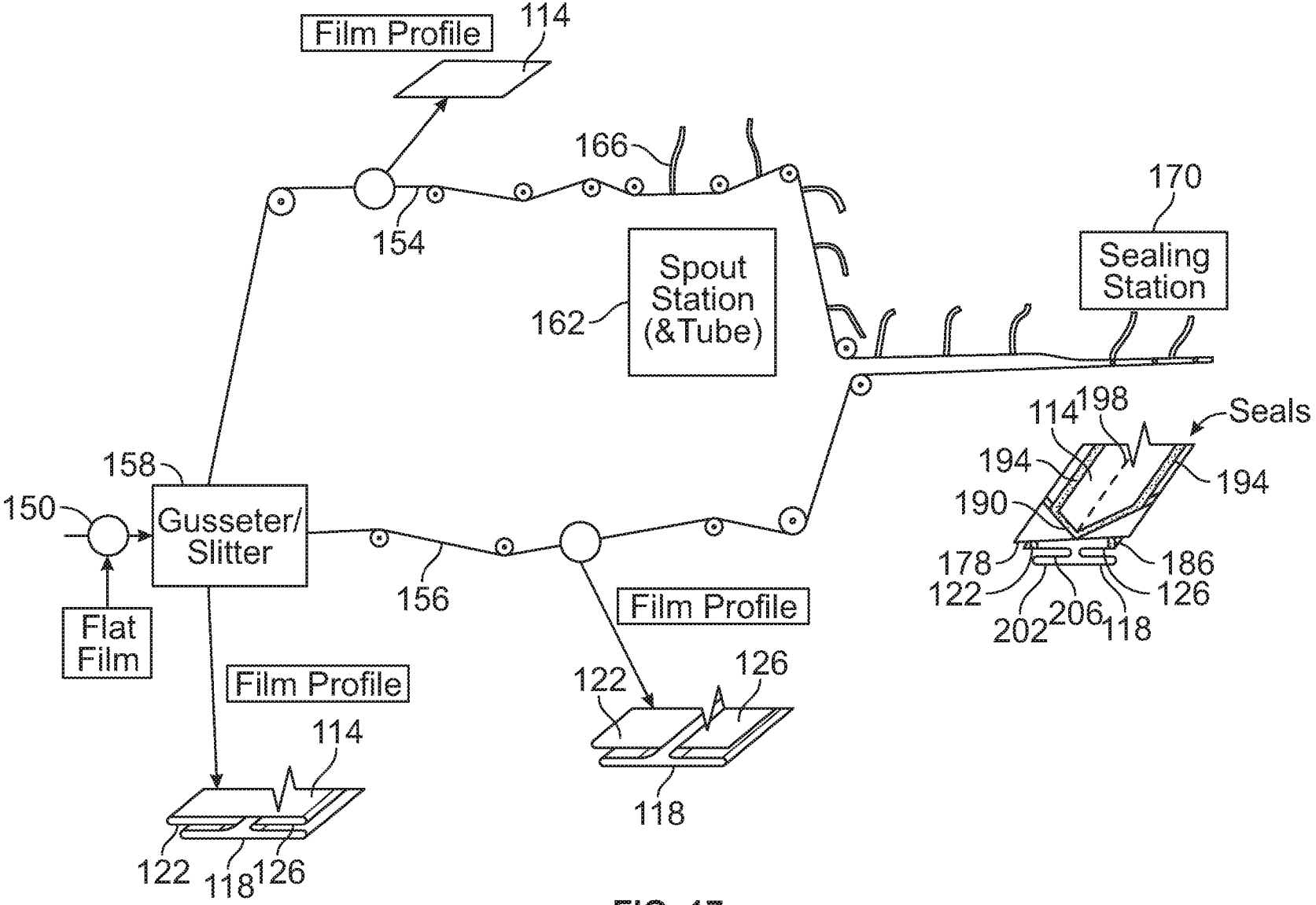
FIG. 17 illustrates a process for making a liner according to an embodiment of the present invention.

FIG. 17 illustrates a method for making the gusseted pouch 14 of FIG. 16*a*. A tube of laminated film 150 made by conventional methods is transported to a gusset/slitter station 158. At the gusset/slitter station 158, the tube 150 of film is folded or gusseted to have a front panel 114, a rear panel 118, a first folded or gusseted side panel 122 extending between the front and rear panels 114 and 118, and a second folded or gusseted side panel 126 extending between the front and rear panels 114 and 118. The gusseted tube of film 150 is then slit to separate the front panel 114 from the first and second side panels 122 and 126. The front panel 114 is transported along a first conveyor 154 and the rear and side panels 118, 122, and 126 are transported along a second conveyor 156 that moves parallel to the first conveyor 154. The front panel 114 is transported to a spout station 162 where a small hole is formed in the front panel 114 and a fitment 166 is connected or sealed to the panel 114 so that that a spout and tube of the fitment 166 are aligned with the hole in the panel 114. The spout may be formed integrally with the tube or the tube may be removably connected to the spout or to an adapter that can be connected to the spout.

After the fitment 166 is added to the front panel 114 at the spout station 162, the first and second conveyors 154 and 156 transport the front panel 114 and the bottom and side panels 118, 122, and 126, respectively, to a sealing station 170. At the sealing station 170, seals 194 are formed by welding or heat sealing between the inner side 178 of the front panel 114 and the top inner sides 186 of the folded side panels 122 and 126. In addition, diagonal seals 190 are formed inward from the side seals 194 to a center vertical axis 198 of the front and rear panels 114 and 118 panels. The diagonal seals 190 are formed between the inner side 178 of the front panel 114 and top inner sides 186 of the folded side panels 122 and 126, between an inner side 202 of the rear panel 118 and bottom inner sides 206 of the folded side panels 122 and 126, and between narrow central portions of the inner side 178 of the front panel 114 and the inner side 202 of the rear panel 118 along the center axis 198.

As shown in the pouch 14 of FIG. 16, the diagonal seals 190 form a sealed bottom portion 110 of the pouch 14. The excess film located below the diagonal seals 190 is trimmed off at a subsequent station so that the bottom portion 110 of the pouch is triangular in shape when the pouch 14 is in its flat state. The film 150 is also trimmed at a desired height above the bottom portion 110 to define an open top portion of the pouch 14.

Figure 18:
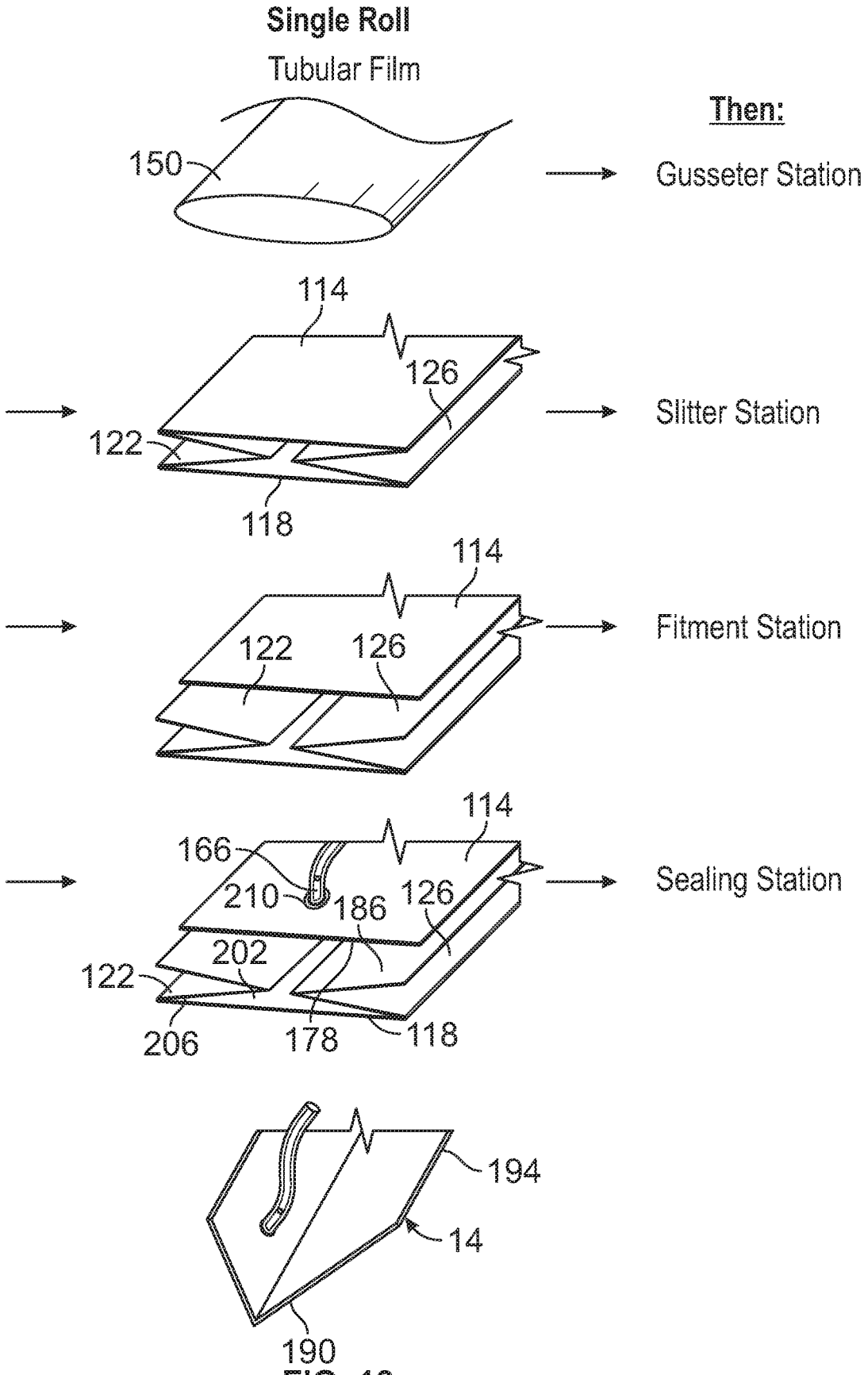
FIG. 18 illustrates a process for making a liner according to an embodiment of the present invention.

FIG. 18 illustrates another view of the process of making the gusseted pouch 14 from a single roll of film 150. The tubular film 150 is fed to a gusset station, at which the film 150 is folded to form a gusseted film 150 having flat front and rear panels 114 and 118 and folded side panels 122 and 126. The gusseted film 150 is fed to a slitter station, at which the front panel 114 is slit and separated from the side panels 122 and 126. The front panel 114 is fed to a fitment station, at which a hole 210 is punched in the front panel 114 and a fitment 166 including a spout and dispending tube is attached to the front panel 114 at the hole 210. The hole 210 is in fluid communication with the spout and tube of the fitment 166. At a sealing station, the inner side 202 of the rear panel 118 is sealed to bottom inner sides 206 of the folded side panels 122 and 126 and the inner side 178 of the front panel 114 is sealed to top inner sides 186 of the folded side panels 122 and 126. The sealing process results in vertical seals 194 running along the sides of the pouch 14 and diagonal seals 190 running downward from the vertical seal to center point at the bottom of the pouch 14.

By way of example, the film 150 is a laminate having a linear low density polyethylene layer and a polyester layer. The inner sides or layers 202, 206, 178, and 186 of the panels 114, 118, 122, and 126 may be polyethylene. The outer sides or layers of the panels 114, 118, 122, and 126 may be polyester.

Figure 19:
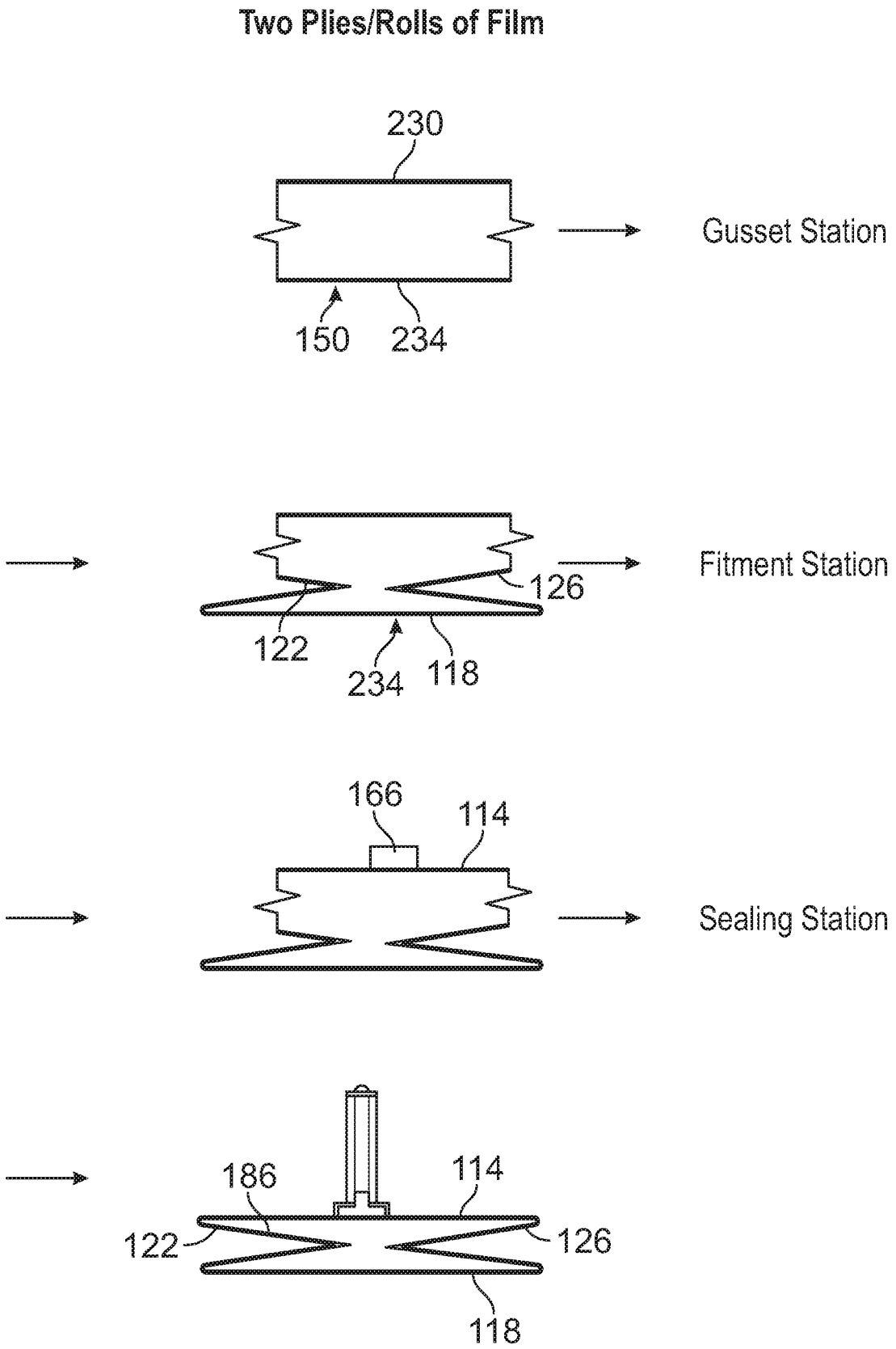
FIG. 19 illustrates a process for making a liner according to an embodiment of the present invention.

FIG. 19 illustrates a method of making the gusseted pouch 14 using two plies or rolls of film 150. A top ply 230 and a bottom ply 234 are separately made and moved in parallel along a conveyor system. The bottom ply 234 is wider than the top ply 230. The top ply defines a front panel 114. At a gusset station, the bottom ply 234 is folded to define a rear panel 118 and two folded side panels 122 and 126. At a fitment station, a fitment 166, such as a spout or a spout and tube assembly, is sealed to the front panel 114. A hole is also formed in the front panel 114. The hole is in communication with a passageway in the fitment 166. At a sealing station, the front panel 114 is sealed to top inner sides 186 of the folded side panels 122 and 126. The front and rear panels 114 and 118 are then sealed to the folded side panels 122 and 126 with the diagonal seals 190 to form a sealed gusseted bottom pouch portion 110 such as that shown in FIG. 16*a*.

Figure 20:
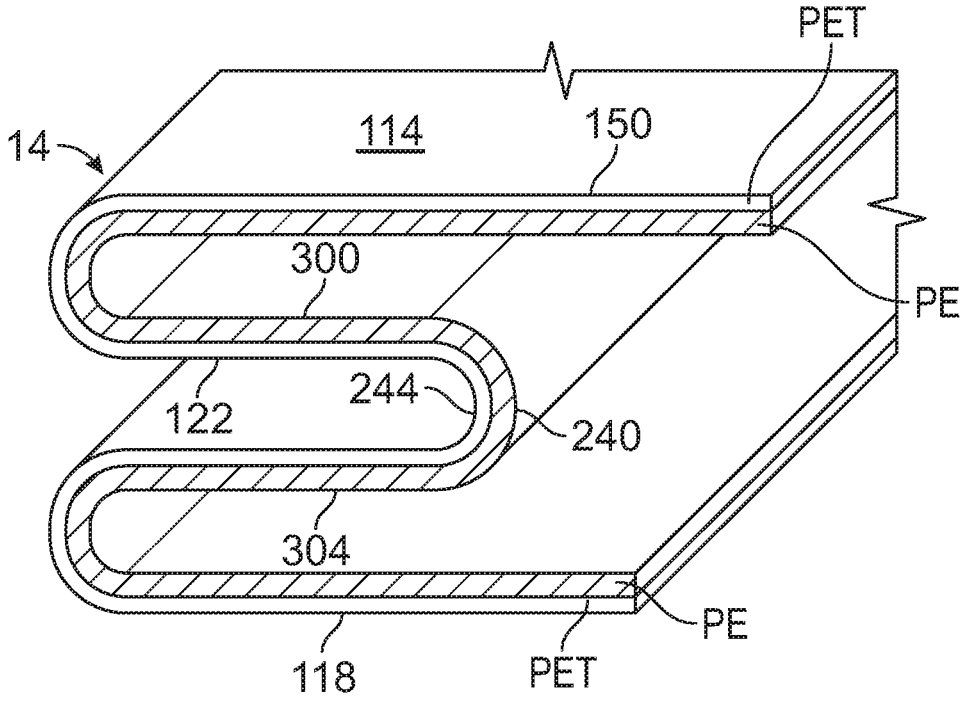
FIG. 20 illustrates a partial perspective view of a liner being made according to an embodiment of the present technology.

FIG. 20 illustrates a cutaway side view of the gusseted pouch 14 before the sealing step. The pouch panels 114, 118, and 122 are made of a laminate film having an inner layer 240 and an outer layer 244. The inner layer 240 is chosen from a material that melts at a lower temperature than the material chosen for the outer layer 244. By way of example, the outer ply or layer 244 is polyester and the inner layer or ply 240 is polyethylene. The inner and outer layers 240 and 244 may be joined by an adhesive. In particular, the outer layer or ply 244 of the front panel 114, folded side panel 122, and rear panel 118 is polyester and the inner layer or ply 240 of the front panel 114, folded side panel 122, and rear panel 118 is polyethylene. The polyester ply has a higher melting temperature than the polyethylene ply. Therefore, heat sealing or welding can be done at a temperature that causes the overlapping inner layers 240 of the front panel 114 and the upper portion 300 of the side panel 122 to seal together and the overlapping inner layers 240 of the rear panel 118 and the lower portion 304 of the side panel 122 to seal together but that does not cause the overlapping outer layers 244 of the upper and lower portions 300 and 304 of the side panel 122 to seal. In particular, the inner layer 240 of one panel can be sealed to the inner layer 240 of an adjacent overlapping panel at approximately 220-400 degrees Fahrenheit but the outer layers 244 of adjacent overlapping panels will not melt or be sealed together at such a temperature range.

Alternatively, the inner and outer plies or layers 240 and 244 of the laminated film 150 may be made of other materials that allow for adjacent and overlapping inner layers 240 of the film to form a seal together at a certain temperature without adjacent and overlapping outer layers 244 forming a seal at that same temperature. For example, the inner layers 240 may be polyethylene and the outer layers 244 may be biaxially oriented nylon, and the layers 240 and 244 are joined together by an adhesive. In addition, the film from which the pouch 14 is made may be a multilayer coextruded blown film with nylon making up the outer layer 244 and polyethylene making up the inner layer 240.

Figure 21:
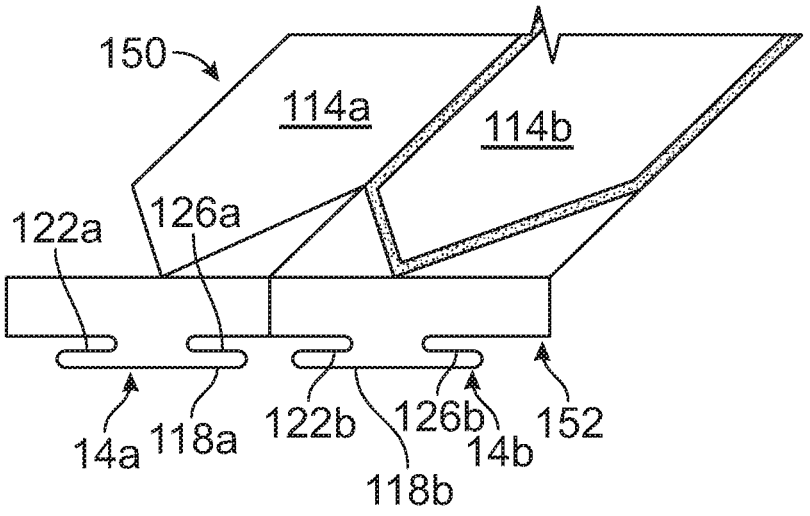
FIG. 21 illustrates a partial perspective view of liners being made according to an embodiment of the present technology.

FIG. 21 illustrates a process for making two gusseted pouches 14 at the same time. A first sheet of film 150 defines two front panels 114*a*, 114*b* for two pouches 14*a*, 14*b*, and a second sheet of film 152 defines two rear panels 118*a*, 118*b* and four side panels 122*a*, 122*b*, 126*a*, 126*b* for the two pouches 14*a*, 14*b*. The top sheet 150 can be made separately from the bottom sheet 152. Alternatively, the top sheet 150 and bottom sheet 152 can both come from the same tube of film, but the top sheet 150 is cut off of the bottom sheet 152. A fitment and hole can be added to each of the two front panels 114*a*, 114*b* at a fitment station. At a sealing station, the top sheet 150 can be sealed to the bottom sheet 152 such that the first front panel 114*a* is sealed to the first set of two side panels 122*a* and 126*a* with two vertical seals and such that the second front panel 114*b* is sealed to the second set of two side panels 122*b* and 126*b* with two vertical seals. The first front and rear panels 114*a* and 118*a* can be sealed to the two side panels 122*a* and 126*a* with diagonal seals, and the second front and rear panels 114*b* and 118*b* can be sealed to the two side panels 122*b* and 126*b* with diagonal seals. The two pouches 14*a*, 14*b* can then be separated from each other by a slitting device, and the excess film beneath the bottom diagonal seals of each pouch 14*a*, 14*b* can be removed by a slitting device.

The gusseted bottom portion 110 of the pouch 14 shown in FIGS. 16 and 22 can be used with any of the reclosable urn liner embodiments disclosed above.

Figure 1B:
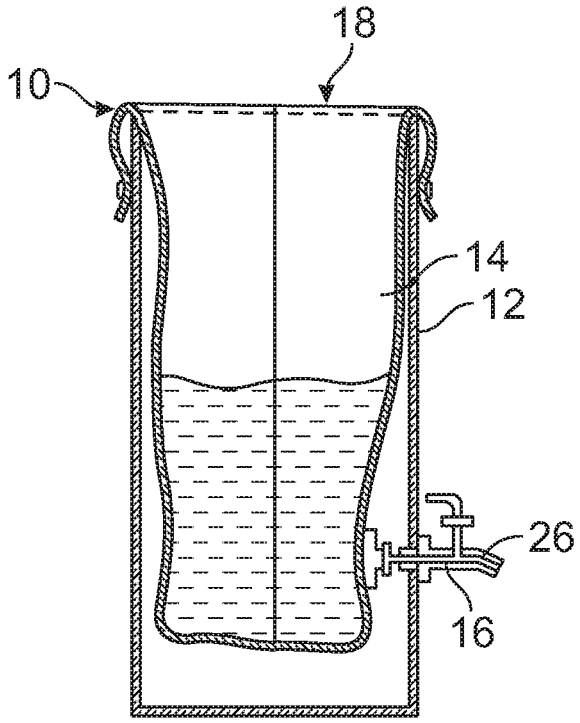
FIG. 1*b* is a cutaway side view of a beverage dispensing system.
Figure 28:
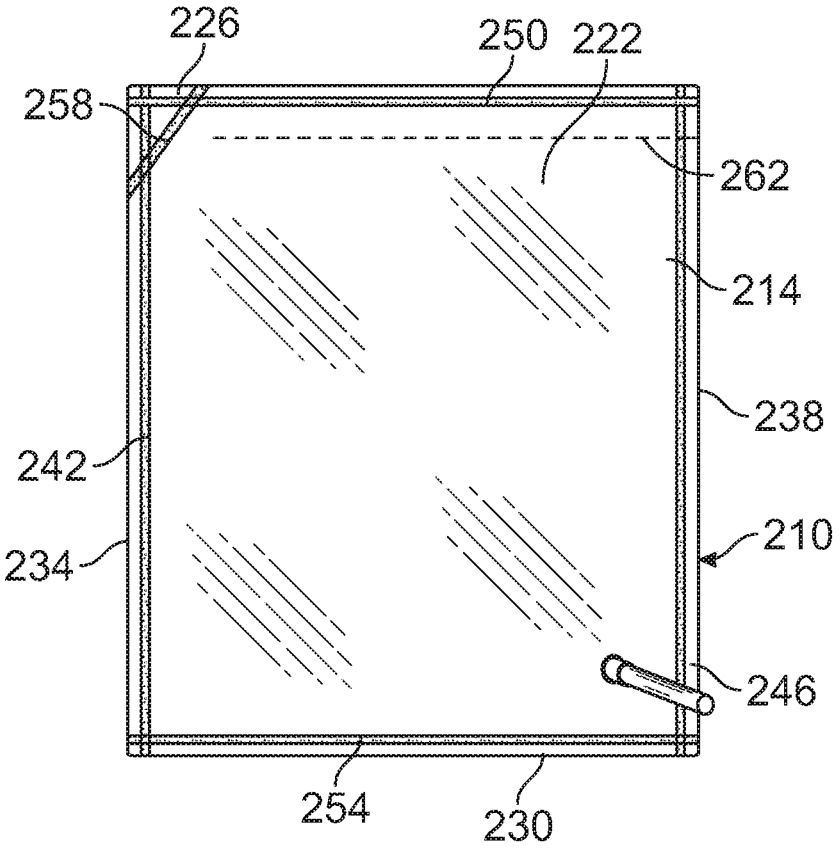
FIG. 28 illustrates a side view of a liner according to an embodiment of the present technology.

FIG. 28 illustrates an alternative embodiment of a liner 210 for use in a beverage urn or vessel, such as an iced tea or coffee urn, such as the one shown in FIG. 1*b*. The liner 210 is made of plastic and has a front panel 214 and a rear panel (not shown) that define an interior region 222. The liner 210 has a top side 226, a bottom side 230, and first and second sides 234 and 238. The front and rear panels are sealed together proximate the sides 234 and 238, top side 226, and bottom side 230 by two side seals 242 and 246, a top seal 250, and a bottom seal 254, respectively. The liner 210 includes a diagonal seal 258 extending at an angle from the first side 234 to the top side 226. The liner 210 includes a perforation 262 located just below the top seal 250. The perforation 262 extends from the second side 238 of the liner 210 to a short distance from the first side 234 of the liner 210 and can extend all the way to the diagonal seal 258. The liner 210 also includes a hole at which is attached a fitment assembly 266 that can include a dispensing tube 27. When the liner 210 is placed in an urn, the tube can be extended through a dispensing valve attached to the urn to dispense the liquid from the interior region 222 of the liner 210.

Figure 29:
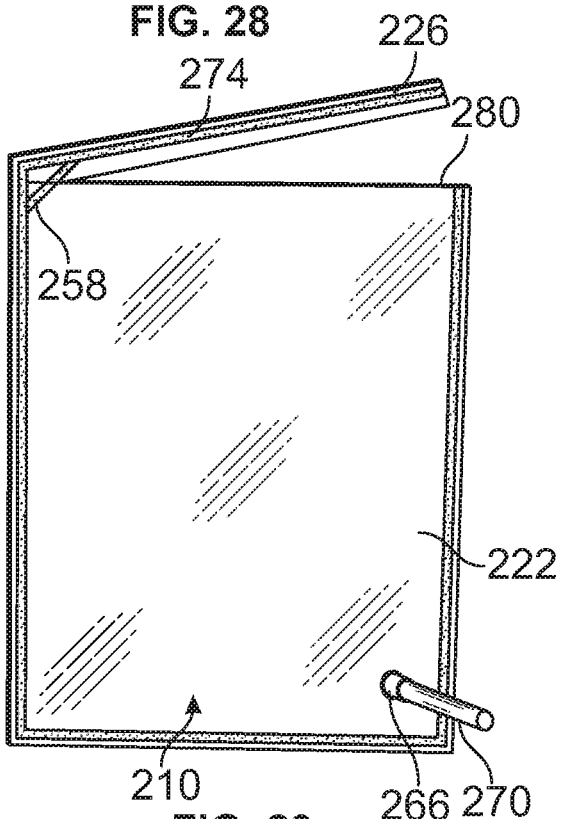
FIG. 29 illustrates a side view of the liner of FIG. 28 with a tear strip partially removed.
Figure 30:
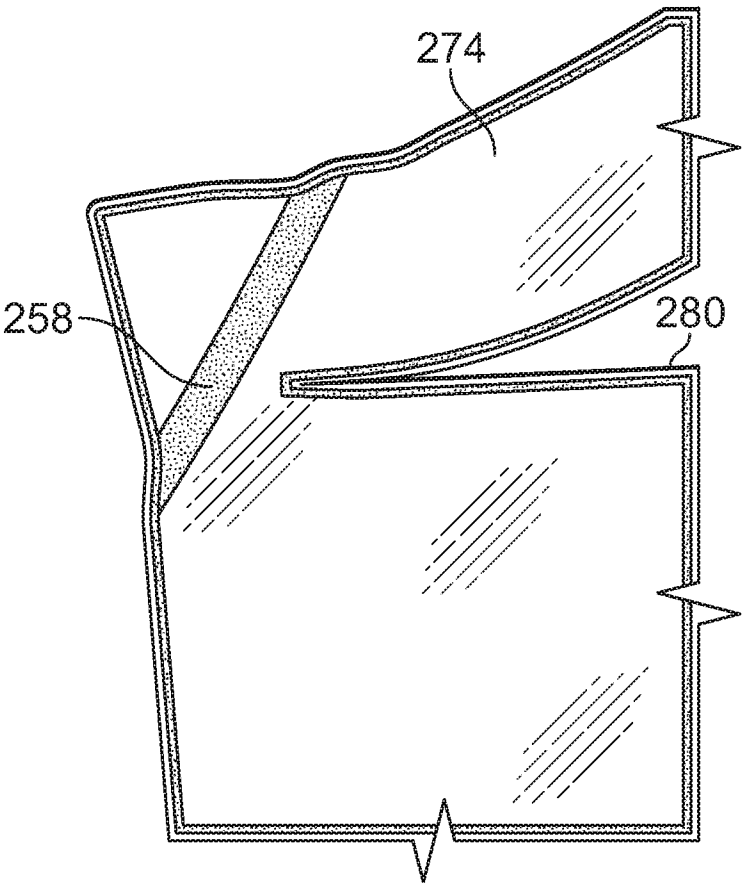
FIG. 30 illustrates a partial side view of the liner of FIG. 29.

With reference to FIGS. 28 and 29, in operation, the liner 210 is placed in a beverage urn and the tube 270 of the fitment 266 is fed through a dispensing valve attached to the urn. A user then pulls the top side 226 of the liner 210 so that the top side 226 tears off along the perforation 262 to create a strip 274 like that shown in FIG. 2. As shown in FIGS. 29 and 30, the user tears the strip 274 off until some point near the diagonal seal 258 and then stops tearing the strip 274 off.

The diagonal seal 258 helps prevent further propagation of the tear along the perforation 262. In this way, the strip 274 is still connected to the rest of the liner 210 and the seal 258 serves as a hinge connecting the strip 274 to a top end of the liner 210. The diagonal seal 258 is not the only way to produce a stopping point in the strip-tearing process. One can place a spot weld or seal in the bag at the stopping point of the tear (not shown) and generate the same effect, which is that the self-contained twist tie strip 274 stops and remains an integral part of the liner 210 so that it can be used to tie off the liner 210.

By removing most of the strip 274 from the liner 210, the user creates an opening 280 at the top of the liner 210 that provides access to the interior region 222. The user can fill the interior region 222 of the liner 210 with liquid, such as tea or coffee, through the opening 280. After the user fills the liner 210 with liquid, there is excess material at the top of the liner 210 that can be twisted together and then tied off with the strip 274 to close off the opening 280 at the top of the liner 210. The user can then put a cover on top of the urn. Tying off the top of the liner 210 and covering the liner 210 with a cover helps prevent tampering with or contamination of the liquid contents of the liner 210. Liquid is then dispensed from the interior region 222 of the liner 210 through the tube 270 and urn dispensing valve.

The user can later empty the liner 210 by removing the liner 210 from the urn, untying the strip 274, and dumping leftover liquid out of the liner 210 through the top opening 280. Alternatively or additionally, the user can untie the strip 274 while the liner 210 is still located in the urn and refill the liner 210 with liquid through top opening 280. The user can then retie the strip 274 around the excess liner material at the top of the liner 10 to close off the opening 280.

Figure 31:
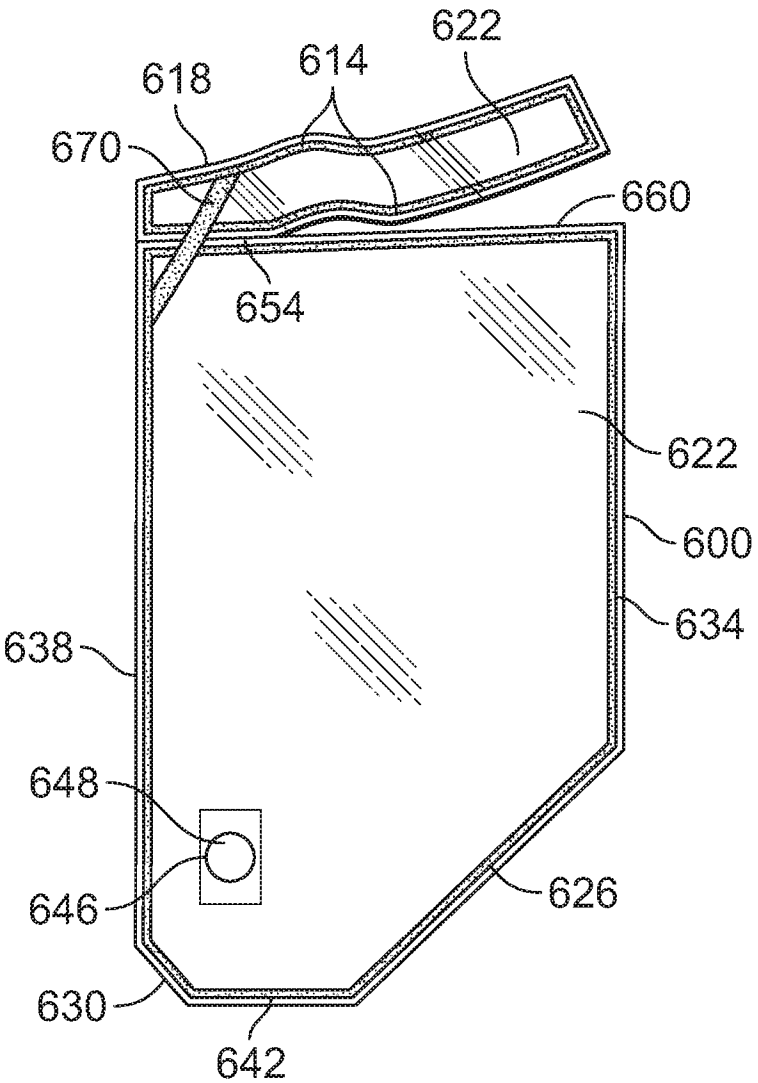
FIG. 31 illustrates a side view of a liner according to an embodiment of the present technology.
Figure 32:
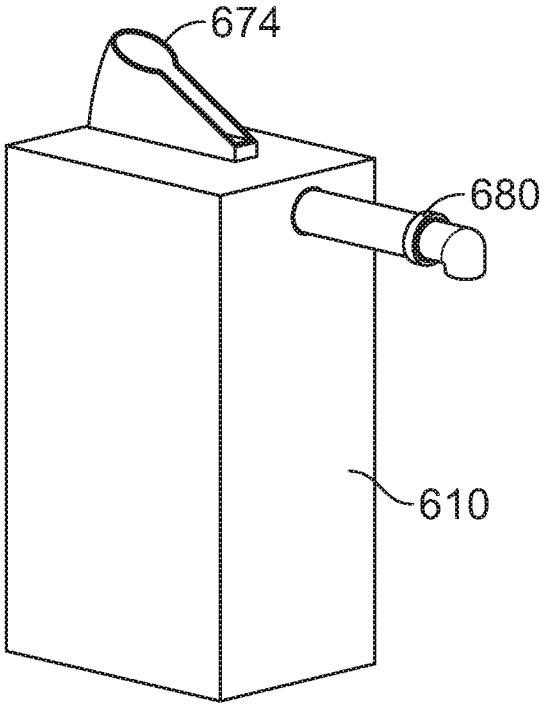
FIG. 32 illustrates a dispenser with which the liner of FIG. 31 can be used.

FIG. 31 illustrates a variation of the liner 600 shown in FIGS. 28-30. The liner 600 can be used in condiment dispensers 610 like that shown in FIG. 32. The liner 600 includes two seals 614 at the top 618 so that the strip 622 has greater strength and durability. The liner 600 also includes two diagonal seals 626 and 630 that extend from the side seals 634 and 638, respectively, to a short bottom seal 642. This allows for better positioning of the liner 600 in the condiment dispenser 610, which may have an angled bottom region. The liner 600 includes a fitment 646 that includes a film covering 648. In operation, the liner 600 is placed in the dispenser 610 with the angled portion of the bottom of the liner 600 positioned on top of the angled bottom region of the dispenser 610. The user tears the top of the liner 600 off along the perforation 654 to create an opening 660 proximate the top 618 of the liner 600 and a tie strip 622 that is connected to the rest of the liner 600 along the diagonal seal 670. The user can fill the interior region 622 of the liner 600 with liquids or flowable foods like condiments through the opening 660. The user can then use the strip 622 to tie off the top of the liner 600. The user then connects the fitment 646 to a dispensing system in the dispenser 610 such that the dispensing system 610 punctures the film 648 on the fitment 646 and the contents of the liner 600 are in fluid communication with the dispensing system 610. The user then places a cover on the dispenser and can use a pump 674 on the dispenser 610 to dispense the contents from the liner 600 onto food via an external dispensing tube 680.

Figure 34:
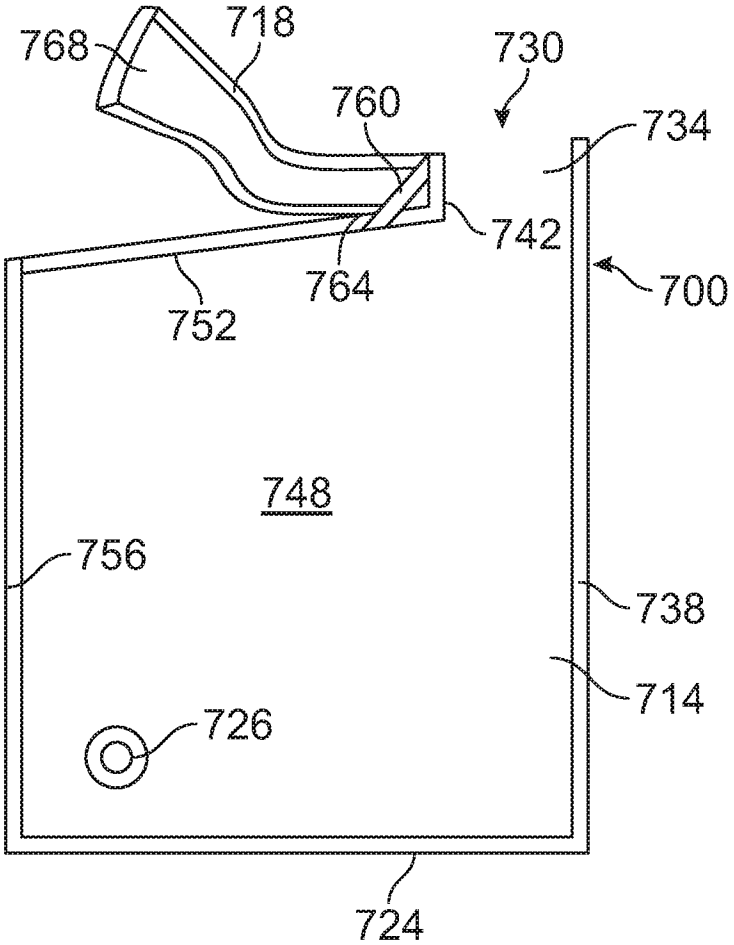
FIG. 34 illustrates a side view of the liner of FIG. 33 with a tear strip partially removed.
Figure 33:
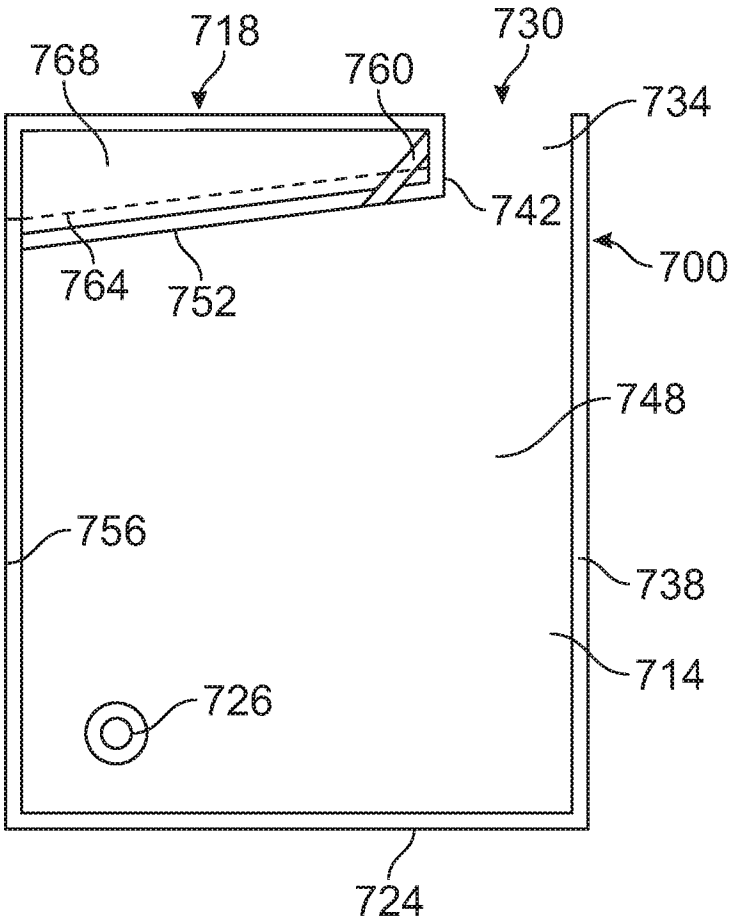
FIG. 33 illustrates a side view of a liner according to an embodiment of the present technology.

FIGS. 33 and 34 illustrate side views of another embodiment of an urn liner 700. The liner 700 includes a sealed top end 718 with a small opening 730 at one side of the top end 718. The liner 700 defines a pouch 714 having an interior region 748. The opening 730 leads to a passageway 734 in the pouch 714 that is defined by an first outer side or seal 738 of the liner 700 that extends from the top end 718 of the liner 700 to the bottom end 724 of the liner 700 and an inner side seal 742 that extends a short distance down from the top end 718 of the liner 700. The passageway 734 allows liquid to enter the interior region 748 of the pouch 714. The liner 700 also includes a fitment assembly 726 that includes a spout and dispensing tube. The liner 700 further includes a diagonal seal 752 that extends from a second outer side or seal 756 of the liner 700 to the bottom of the inner side seal 742. A second diagonal seal 760 extends from the top of the inner side seal 742 to the diagonal seal 752. A perforation 764 is located a short distance above the diagonal seal 752 and runs parallel to the diagonal seal 752 from the second outer seal 756 to the second diagonal seal 760. The portion of the liner 714 defined by the top end 718, perforation 764 and second diagonal seal 760 defines a tear strip 768.

In operation, a user can place the liner 700 in a beverage urn and fill the pouch 714 by pouring liquid, such as tea or coffee or another flowable food, into the opening 730 and through the passageway 734 into the interior region 748. After the user has filled the pouch 714, the user can pull the tear strip 768 along the perforation 764 to the second diagonal seal 760, which serves to help stop further propagation of the tear. The user can then use the tear strip 768 to tie off the passageway 734. In this way, the tear strip 768 can be used to close off the liner 700 to help prevent contaminants from getting into the pouch 714 or the liquid in the pouch 714. The user can then place a lid on the beverage urn. The user can always untie the tear strip 768 to re-fill the pouch 714 in the urn with more liquid and then re-tie the tear strip 768 to close off the passageway 734. When the user is done with the liner 700, the user can remove the liner 700 from the urn and throw it out and replace it with another liner 700 and repeat the process.

It is to be understood that the invention is not limited in its application to the details of construction and the arrangement of the components set forth in the description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention.

The invention claimed is:

1. A liner for use with a fluid dispensing vessel, comprising:

a flexible pouch defining an interior region and configured to be placed in a fluid dispensing vessel, the pouch including:

a top end that is partially sealed by a top seal and that includes a first opening;

first and second side ends extending from the top end to a bottom end, wherein the top end, first and second side ends, and bottom end define a perimeter of the pouch;

a fluid passageway defined by at least two sealed boundaries that extend downward from the top seal more than half way down the height of the first and second side ends but that do not extend to the bottom end and that do not extend above the first opening, wherein at least portions of the sealed boundaries are generally parallel to each other and the side ends and are generally perpendicular to the top and bottom ends and wherein the fluid passageway leads from the first opening to the interior region;

a bottom portion that includes a second opening;

a fluid dispensing fitment connected to the pouch and configured to be in fluid communication with interior region via the second opening; and wherein fluid is poured into the interior region of the pouch through the first opening and dispensed from the pouch through the fitment.

2. The liner of claim 1, wherein the first opening is funnel shaped.

3. The liner of claim 1, wherein the first opening makes up less than half of a length of the top end of the pouch.

4. The liner of claim 1, further including a hollow flap that extends up above the top end of the pouch, wherein the first opening is located at a top end of the flap and a channel in the flap connects the first opening to the fluid passageway.

5. The liner of claim 4, wherein the flap can be folded, twisted or tied to close off the opening.

6. The liner of claim 4, wherein the first opening is funnel shaped.

7. The liner of claim 4, further including a strip that extends up above the top end and that is configured to be used to tie off the flap.

8. The liner of claim 4, further including a handle extending up above a portion of the top end.

9. The liner of claim 1, further including a perforation above the sealed portion of the top end of the pouch, wherein a user can tear a strip off of the liner along the perforation to expose the top end of the liner and create a flap extending up above the top end of the liner.

10. The liner of claim 1, further including a perforation above and generally parallel to the sealed portion of the top end of the pouch and a corner seal that extends from the sealed portion of the top end and one of the two sealed boundaries that defines the passageway, wherein a user can tear a strip off of the liner along the perforation up to the corner seal to create a tear strip that is partially connected to the pouch, the tear strip being configured to be used to tie off the passageway after the pouch has been filled with fluid.

11. The dispensing system of claim 1, wherein the pouch includes a front panel, a rear panel, and first and second side panels, and the first and second side panels are folded to have gussets.

12. The dispensing system of claim 11, wherein the gusseted side panels can be unfolded so that a bottom end of the pouch has a generally quadrilateral shape.

13. The liner of claim 1, wherein the liner is configured to dispense either liquid beverages or flowable foods.

14. The liner of claim 1, wherein the liner is configured to be positioned in a beverage dispensing urn.

15. The liner of claim 1, wherein the liner comprises a laminated plastic film having an inner layer and an outer layer and the outer layer has a higher melting point than the inner layer.

16. The liner of claim 1, wherein the liner comprises a laminated plastic film having a polyester layer joined to a polyethylene layer by an adhesive.

17. The liner of claim 1, wherein the liner comprises a laminated plastic film having a biaxially oriented nylon layer joined to a polyethylene layer by an adhesive.

18. The liner of claim 1, wherein the liner comprises a laminated plastic film having a multilayer coextruded blown film with nylon on an outer layer and polyethylene in an inner layer.

19. The liner of claim 1, wherein one or more of the at least two sealed boundaries and that leads from the opening to the interior region is oriented at a diagonal to the top end.

20. The liner of claim 1, further comprising a second seal located below the top end and above the bottom end, the second seal extending from one side end of the liner to one of the at least two sealed boundaries.

21. The liner of claim 1, further comprising a dispensing tube to dispense the liquid from the interior region of the liner pouch.

22. The liner of claim 21, wherein the fitment further comprises a spout, wherein the dispensing tube is one of integrally formed with the spout or removably connectable to the spout.

23. The liner of claim 21, wherein the fitment further comprises a tube adapter to connect the dispensing tube to the fitment.

24. The liner of claim 21, wherein the dispensing tube is configured to extend through a valve attached to a beverage dispensing urn.

25. The liner of claim 1, wherein the two sealed boundaries are formed by heat seals.

26. The liner of claim 1, wherein the two sealed boundaries start on opposite sides of the first opening and extend downward toward the bottom end from the first opening.

27. The liner of claim 1, wherein the first opening is not located below any portion of the top end.

* * * * *